US009301066B2

(12) United States Patent
Burleigh et al.

(10) Patent No.: US 9,301,066 B2
(45) **Date of Patent: *Mar. 29, 2016**

(54) AUDITORY COMPREHENSION AND AUDIBILITY DEVICE

(71) Applicant: Brain Basket, LLC, Boulder, CO (US)

(72) Inventors: Joan Billger Burleigh, Boulder, CO (US); Joan Phillips Waldron, Boulder, CO (US)

(73) Assignee: Brain Basket, LLC, Boulder, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/646,263

(22) Filed: Oct. 5, 2012

(65) Prior Publication Data

US 2013/0089226 A1 Apr. 11, 2013

Related U.S. Application Data

(60) Provisional application No. 61/543,937, filed on Oct. 6, 2011.

(51) Int. Cl.
*H04R 25/00* (2006.01)
*H04R 15/00* (2006.01)
(Continued)

(52) U.S. Cl.
CPC ..... *H04R 25/658* (2013.01); *H04R 15/00* (2013.01); *H04R 5/033* (2013.01); *H04R 25/70* (2013.01);
(Continued)

(58) Field of Classification Search
CPC ..... H04R 25/00; H04R 15/00; H04R 25/658; H04R 25/70; H04R 25/75; H04R 2499/11; H04R 2225/43; H04R 5/033; H04R 31/00; H04R 2205/024; H04R 2201/103; H04R 2205/022; H04R 2420/07; H03H 9/00
USPC ..... 381/326, 328, 331, 151, 380, 400, 190; 600/25; 607/55–57; 379/52, 44, 443
See application file for complete search history.

(56) References Cited

U.S. PATENT DOCUMENTS 2,031,789 A 2/1936 Pierce
2,063,944 A 12/1936 Pierce
(Continued)

FOREIGN PATENT DOCUMENTS

EP 1439737 7/2004
JP 2011069704 * 4/2011 ..... G01R 33/032
(Continued)

OTHER PUBLICATIONS

International Search Report and Written Opinion mailed Sep. 15, 2009, in PCT Application Serial No. PCT/US2009/050288.
(Continued)

*Primary Examiner* — Davetta W Goins
*Assistant Examiner* — Oyesola C Ojo
(74) *Attorney, Agent, or Firm* — William W. Cochran; Cochran Freund & Young LLC

(57) ABSTRACT

Disclosed is an auditory comprehension and audibility device that assists users in hearing and comprehending auditory signals. The auditory comprehension and audibility device includes a magnetostrictive pad and a multi-turn coil that is disposed on the magnetostrictive pad. The multi-turn coil is electrically isolated from other devices, such as a speaker. An optional permanent magnet can also be placed on the magnetostrictive pad, which may help increase audibility of said auditory signals. The auditory comprehension and audibility device can be used in mobile phone covers, head phones, hearing aids and other devices that are used for hearing.

13 Claims, 43 Drawing Sheets

(51) Int. Cl.
*H04R 31/00* (2006.01)
*H04R 5/033* (2006.01)

(52) U.S. Cl.
CPC ..... *H04R 25/75* (2013.01); *H04R 31/00* (2013.01); *H04R 2225/43* (2013.01); *H04R 2499/11* (2013.01); *Y10T 29/49005* (2015.01)

(56) References Cited

U.S. PATENT DOCUMENTS 2,791,732 A 5/1957 Jones
3,774,134 A 11/1973 Kardashian et al.
3,968,693 A 7/1976 Kazahaya
4,236,230 A 11/1980 Thompson
4,366,349 A * 12/1982 Adelman ..... H04R 25/353 381/316
4,499,515 A 2/1985 Piotrowski et al.
4,520,413 A 5/1985 Piotrowski et al.
4,606,329 A 8/1986 Hough
4,716,556 A 12/1987 Raskin et al.
4,776,322 A 10/1988 Hough et al.
4,904,233 A 2/1990 Hakansson et al.
5,015,225 A 5/1991 Hough et al.
5,062,198 A 11/1991 Sun
5,176,620 A 1/1993 Gilman
5,216,806 A 6/1993 Lam
5,258,707 A 11/1993 Begin et al.
5,260,615 A 11/1993 Sahashi et al.
5,338,287 A 8/1994 Miller et al.
5,425,104 A * 6/1995 Shennib ..... G09B 21/009 381/326
5,729,131 A 3/1998 Begin
5,793,875 A * 8/1998 Lehr ..... H04R 25/554 381/313
6,137,889 A 10/2000 Shennib et al.
6,176,943 B1 1/2001 Wun-Fogle et al.
6,320,479 B1 * 11/2001 Alers ..... H03H 9/135 310/26
7,250,839 B2 7/2007 Racz
7,391,342 B1 * 6/2008 Mui ..... H03M 11/24 341/22
7,929,711 B2 4/2011 Burleigh
7,978,867 B2 7/2011 Waldron et al.
8,363,862 B2 1/2013 Burleight
8,761,423 B2 * 6/2014 Wagner ..... H04R 25/602 381/322
2002/0012438 A1 * 1/2002 Leysieffer ..... A61N 1/36032 381/312
2002/0035309 A1 3/2002 Leysieffer
2003/0048915 A1 3/2003 Bank
2004/0234092 A1 11/2004 Wada et al.
2004/0252812 A1 * 12/2004 Waldron ..... H04M 1/03 379/52
2005/0020873 A1 1/2005 Berrang et al.
2005/0113633 A1 5/2005 Blau et al.
2005/0117713 A1 * 6/2005 Waldron ..... H04M 1/03 379/52
2005/0244022 A1 * 11/2005 Muthuswamy ..... H04M 1/03 381/315
2006/0029248 A1 * 2/2006 Waldron ..... H04M 1/6016 381/400
2007/0041595 A1 2/2007 Carazo et al.
2007/0083078 A1 4/2007 Easter et al.
2007/0108973 A1 5/2007 Lanning et al.
2007/0286442 A1 * 12/2007 Hessel ..... H04R 25/60 381/322
2008/0269829 A1 * 10/2008 Li ..... A61L 27/06 607/36
2009/0162810 A1 * 6/2009 Werner et al. ..... 433/119
2010/0008524 A1 * 1/2010 Burleigh ..... H04R 15/00 381/190
2010/0237976 A1 * 9/2010 Li ..... H01F 17/0013 336/200
2011/0126640 A1 * 6/2011 Klode ..... G01L 1/125 73/862.333

FOREIGN PATENT DOCUMENTS

WO 9414293 6/1994
WO 9621333 7/1996
WO 2007044460 4/2007

OTHER PUBLICATIONS

International Search Report and Written Opinion mailed Feb. 5, 2013, in PCT Application Serial No. PCT/US2012/59026.
U.S. Appl. No. 61/080,180, filed Jul. 11, 2008, by Joan M. Burleigh.

* cited by examiner

Impedance of HPA-1000C (Non-Retrofitted) headphone

1500

2nd and 4th (EVEN) order distortion of HPA-1000C (Non-Retrofitted) headphones at 63 mV drive

1700

3rd and 5th (ODD) order distortion of HPA-1000C (Non-Retrofitted) headphones at 63 mV drive

1800

2nd and 4th (EVEN) order distortion of HPA-1016C (Retrofitted Technology) headphones at 63 mV drive

1900

3rd and 5th (ODD) order distortion of HPA-1016C (Retrofitted Technology) headphones at 63 mV drive

2000

THD of HPA-1000C (Non-Retrofitted) headphones at 63 mV drive

2100

THD+N of HPA-1000C (Non-Retrofitted) headphones at 63 mV drive

2200

THD of HPA-1016C (Retrofitted Technology) headphones at 63 mV drive

2300

THD+N of HPA-1016C (Retrofitted Technology) headphones at 63 mV drive

2400

AUDITORY COMPREHENSION AND AUDIBILITY DEVICE

CROSS-REFERENCE TO RELATED APPLICATION

This application is based upon and claims the benefit of U.S. provisional application No. 61/543,937, entitled "Auditory Comprehension and Audibility Device," filed Oct. 6, 2011, the entire disclosure of which is herein specifically incorporated by reference for all that it discloses and teaches.

BACKGROUND OF THE INVENTION

Portable hearing devices have been very effective in assisting individuals that have impaired hearing and/or comprehension in difficult listening environments to more clearly hear, understand and enjoy auditory signals. Depending upon the type of impairment that an individual may have, or the environment in which the individual may have difficulty hearing, hearing devices may operate more efficiently with some individuals and not as well with others. Many of the problems associated with hearing loss as well as comprehension of audible signals are not well understood. A large number of factors can affect both hearing and comprehension of various types of audible signals. As a result, hearing devices that aid a user in hearing and comprehending audible signals may not be simply dependent upon amplification of the audible signal at specified frequencies.

SUMMARY OF THE INVENTION

An embodiment of the present invention may therefore comprise a hearing device that assists users having impaired auditory comprehension of sounds generated by a speaker comprising: a magnetostrictive pad that changes size in response to a magnetic field; a conductive wire formed in a multi-turn coil that is disposed proximate to the magnetostrictive pad and electrically isolated from the speaker; the magnetostrictive pad and the multi-turn coil disposed proximate to the speaker, such that the sounds generated by the speaker are altered to provide increased speech discrimination and audibility of sound.

An embodiment of the present invention may further comprise a method of increasing auditory comprehension and the audibility of auditory signals generated by a speaker comprising: providing a magnetostrictive pad; providing a multi-turn coil disposed on the magnetostrictive pad that is electrically isolated from the speaker; placing the magnetostrictive pad and the multi-turn coil proximate to the speaker so that the auditory signals generated by the speaker are altered to provide increased speech discrimination for listeners.

DETAILED DESCRIPTION OF THE EMBODIMENTS

Figure 1:
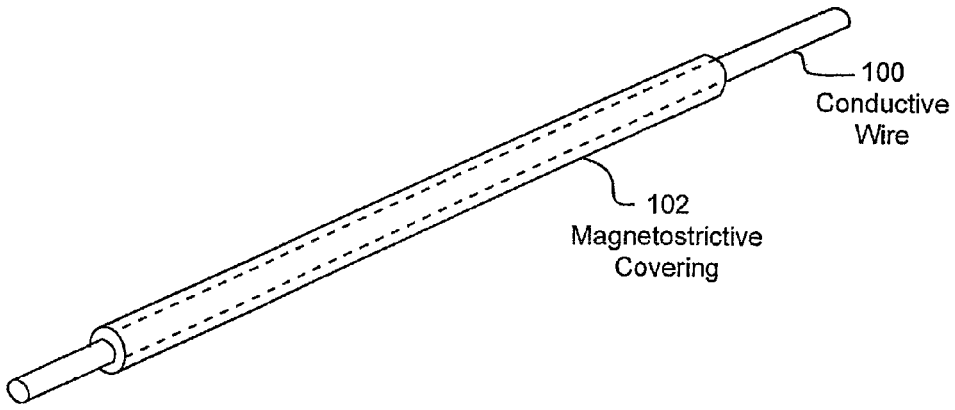
FIG. 1 is a schematic illustration of one embodiment of a conductive wire covered with a magnetostrictive covering.

FIG. 1 is a schematic illustration of a conductive wire 100 that is covered by a magnetostrictive covering 102. The magnetostrictive covering can comprise any of the magnetostrictive materials. For example, the magnetostrictive covering 102 may be a magnetostrictive film, an amorphous metallic alloy, a metallic glass, a metallic ribbon, a glassy metal, a ribbon alloy, a shaped memory alloy, a metallic foil, a metallic polymer or other materials and shapes. In addition, metallic polymers can be extruded over the conductive wire 100 using standard extrusion techniques for placing covers over wires to form the magnetostrictive covering 102. Magnetostrictive materials convert magnetic energy into kinetic energy, or the reverse, and are typically used to build actuators and sensors. Magnetostrictive properties can be quantified by the magnetostrictive coefficient (L), which is the fractional change in length as the magnetization of the material increases from zero to a saturation value.

Cobalt exhibits the largest room temperature magnetostriction of a pure element at 60 microstrain. Among alloys, the highest known magnetostriction is exhibited by Terfenol-D. Terfenol-D is represented as ThxDyl-xFe2. Terfenol-D exhibits approximately 2,000 microstrains in a field of 2 kOe (160 kA/m) at room temperature. Terfenol-D is the most widely used magnetostrictive material, but other materials can be used. As indicated above, it can be used as an alloy or mixed with polymers that can be extruded over the conductive wire 100. Terfenol-D can also be mixed with polymers to form a film, as disclosed in more detail below. Of course, any suitable magnetostrictive material can be used in the manner illustrated in the various embodiments disclosed herein. Terfenol-D is one example of a substance having high magnetostrictive properties, but other materials can certainly be utilized. As reported by Geoffrey P. McKnight of UCLA Active Material Labs, magnetostrictive materials are broadly defined as materials that undergo a change in shape due to a change in the magnetization state of the material. Nearly all ferromagnetic materials exhibit a change in shape resulting from a magnetization change. In most common materials, such as nickel, iron and cobalt, the change in length is on the order of ten parts per million. In addition, the change in volume is very small. This type of magnetostriction has been termed Joule magnetostriction, after James P. Joule's discovery of magnetostriction in the 1850s. The relatively small change in shape of these materials has limited the use of these materials in engineering. The use of magnetostrictive materials in engineering essentially began with the discovery of very large magnetostriction in rare earth alloys, which were on the order of thousands of parts per million. This occurred in the 1960s by A. E. Clark and others. The culmination of research into an engineering alloy that incorporated rare earth materials was Terfenol-D, as specially formulated to include terbium, dysprosium and iron. Terfenol-D exhibits large magnetostriction at room temperature under relatively small applied fields. Earlier alloys exhibited large magnetostriction, but either in very large magnetic fields, or at cryogenic temperatures, or both. Terfenol-D overcame the temperature difficulty by incorporating an $RFe_2$ microstructure, which raised the curie temperature above room temperature. The necessary magnetic field was reduced by balancing the ratio of terbium and dysprosium, two elements with oppositely signed magnetocrystalline anisotropy, such that the effective anisotropy of the compound was near zero at room temperature. Terfenol-D has become the pre-eminent magnetostrictive material, although research continues into new materials that can produce similar results. For example, various test results were obtained using a Foshan Hauxin microlite metal, which is a nanocrystalline alloy available from Foshan Hauxin Micrometals Company Ltd, No. 6, Gongye Road, B Section, Shishan Industrial Zone, Nanhai Dist., Foshan, Guangdong, China. In addition, an amorphous alloy is also available and has been used in various tests that is also available from Foshan Hauxin Micrometals Company Ltd.

As shown in FIG. 1, the magnetostrictive covering 102 has a certain thickness. The response of the magnetostrictive covering 102 is dependent, at least to some extent, upon the thickness of the magnetostrictive covering 102. In other words, the time response and the amount the magnetostrictive covering 102 change in size depend upon the thickness of the magnetostrictive covering 102.

Figure 2:
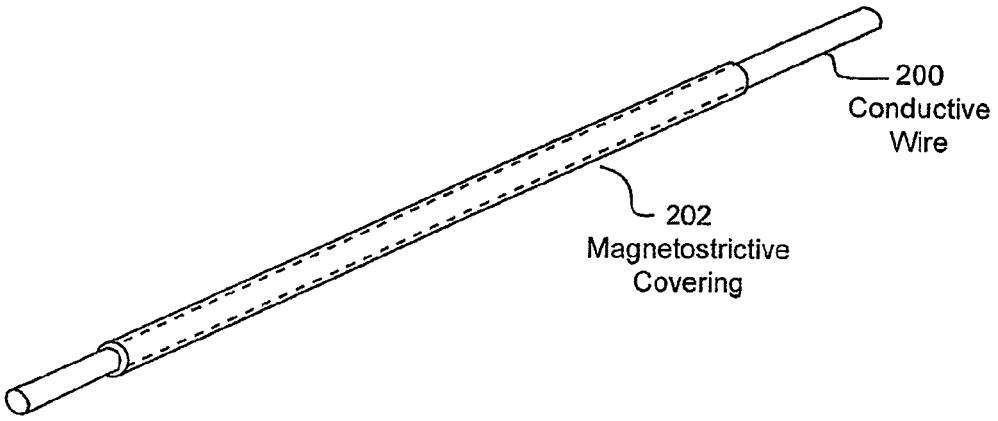
FIG. 2 is a schematic illustration of another embodiment of a conductive wire covered with a magnetostrictive covering.

FIG. 2 illustrates another embodiment of a conductive wire that is covered by a magnetostrictive covering 202. As shown in FIG. 2, the magnetostrictive covering 202 is thinner than the magnetostrictive covering 102 illustrated in FIG. 1. Magnetostrictive covering 202 has a quicker response time than the magnetostrictive covering 102 of FIG. 1 as a result of the fact that the magnetostrictive covering 202 is thinner. The delayed response of the magnetostrictive covering 102 is utilized in accordance with the various embodiments disclosed herein. Layering of 1 mm films can provide 8 mm film which can be effectively used on a diaphragm. Also, any desired thickness of the magnetostrictive material, that is mixed with a polymer, can be extruded directly on a diaphragm. Further, the magnetostrictive material can be mixed with a polymer that is suitable to function as a diaphragm, so that the diaphragm can be extruded or molded with the magnetostrictive material disposed in the diaphragm.

Figure 3:
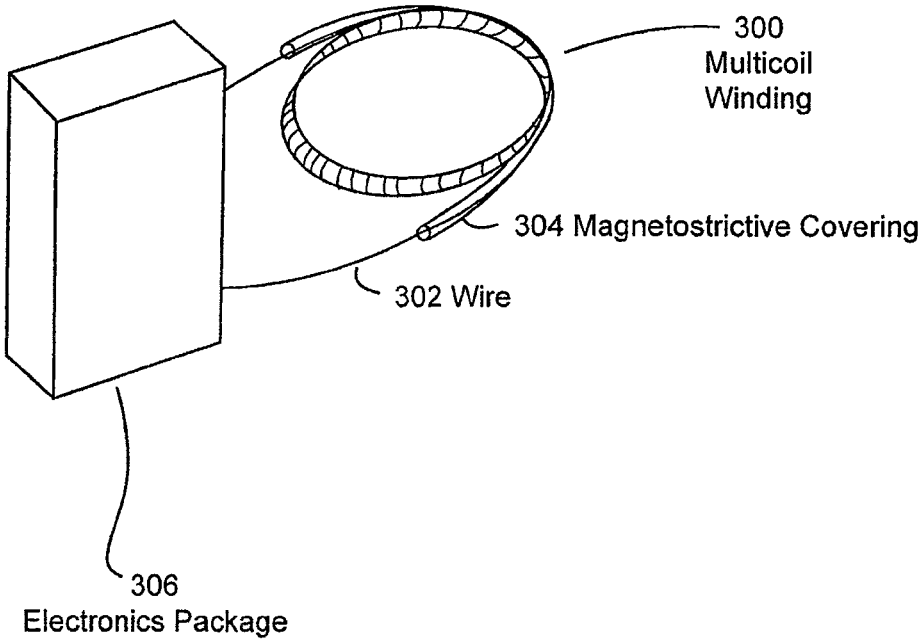
FIG. 3 is a schematic illustration of a multi-coil winding that uses conductive wires having magnetostrictive covering.

FIG. 3 is a schematic illustration of another embodiment. As shown in FIG. 3, a multi-coil winding 300 is made from a wire 302 that is covered with a magnetostrictive covering or coating 304. The magnetostrictive covering 304 reacts to the magnetic field that is created by the current that passes through wire 302, which is applied to the wire 302 by the electronics package 306. Electronics package 306 can include any type of electronics including digital signal processors, microprocessors, active filters, amplifiers, etc. The magnetic field generated by the multi-coil winding 300 causes the magnetostrictive covering 304 to change size. The multi-coil winding 300 with the magnetostrictive coating 304 can be used for hearing devices, as explained more fully below. The advantage of using a conductive wire, such as a copper wire, is that a copper wire, or similar wire, such as a silver wire, has very low resistance and is very efficient in generating a magnetic field. Materials that are magnetizable, such as ferrite based materials, have greater resistance and are therefore less efficient. Because of the small size of most hearing devices, efficiency of the system is important. Very small battery packs must be used in such small devices, which require higher efficiency. Hence, the highly conductive wire, such as a copper wire or a silver wire that is coated with a magnetostrictive material, has the advantage of generating a magnetic field very efficiently while allowing the magnetostrictive materials to expand and contract to efficiently generate the vibrations that enhance the auditory comprehension and audibility of the user.

Magnetostrictive materials, as indicated above, change shape and produce mechanical energy in response to a magnetic field. Conversely, the change in shape of the magnetostrictive material stores energy so that when the magnetostrictive material returns to its original state, the magnetostrictive material generates a magnetic field that, in turn, will induce current in the coil. In this fashion, use of magnetostrictive material reduces the required current to drive the coil, which results in the efficient use of energy and minimal drainage of power from the battery. In that regard, field tests have been performed using a magnetostrictive layer of Terfenol-D material having a length of 1¾ inches, width of 19/32 inches, and a depth of 16 mm. The Terfenol-D material was fitted with a coil of copper wire having a gauge of 36 with 100 turns, without the ends connected. The device was placed on a behind-the-ear Starkey, Model 675, Power Behind-the-Ear hearing aid that was worn on the right ear for 24 hours a day, 7 days a week. The battery life with the retrofitted hearing aid lasted 11 days in most instances and 12-14 days in another instance. The same behind-the-ear Starkey, Model 675, power hearing aid that was not retrofitted was worn on the right ear for 24 hours a day, 7 days a week. The battery life without the retrofit was between 2-3 days in all instances. The batteries used were Duracell Activair Zinc—Air Battery size 675/1.45 volts. A second Starkey behind-the-ear Model 675 power hearing aid was retrofitted with the same size devices described above and worn on the left ear for approximately 16 hours a day, 7 days a week. The battery life was 24 days in one instance and 28 days in another instance. The same Starkey, Model 675, power hearing aid that was not retrofitted was worn on the left ear for approximately 16 hours a day, 7 days a week, and resulted in battery life that last for 3 days in one instance and 4 days in another instance. These tests clearly indicate that the average length of battery life is substantially increased using the magnetostrictive device, as described herein.

The number of windings utilized in the multi-coil winding 300 that is illustrated in FIG. 3 affects the magnitude of the magnetic field that is generated by the multi-coil winding 300. It is also believed that the spectral response of the auditory vibrations of the magnetostrictive coating 304 is affected by the number of windings. Hence, a hearing device can be empirically tuned to provide the desired spectral response by changing the number of windings in the coil.

Figure 4:
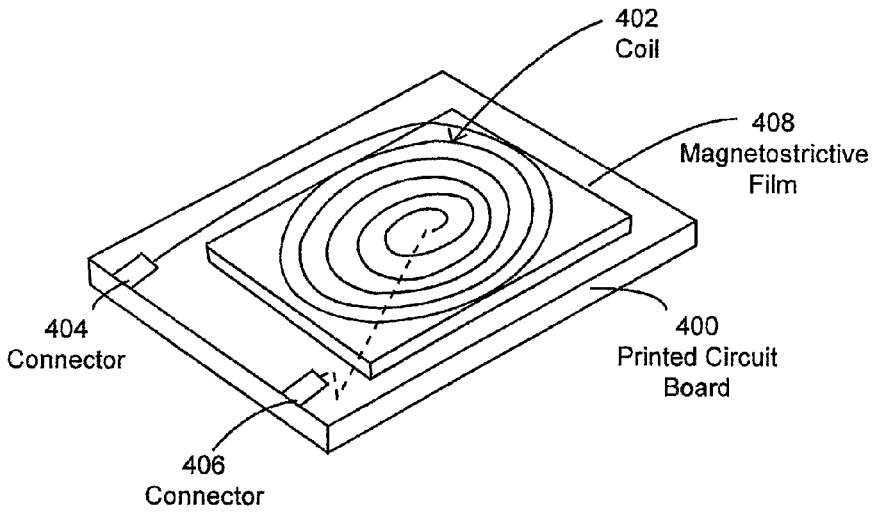
FIG. 4 is a schematic illustration of one embodiment of a printed circuit board device.

FIG. 4 is a schematic illustration of a coil 402 that is disposed on a printed circuit board 400. As shown in FIG. 4, connectors 404, 406 are used to connect to the spiral coil 402. The spiral coil 402 has a spiral shape, rather than a ring shape. In that regard, the term coil is used herein to include both helicoidal as well as ring coils. Electrical connections can be made to the connectors 404, 406 to drive a current through the spiral coil 402. The coil 402 and connectors 404, 406 are printed circuit board traces on the surface of the printed circuit board 400. The current that is applied to the coil 402 causes a magnetic field to be generated that is substantially perpendicular to the coil 402 at the surface of the printed circuit board 400. A magnetostrictive film 408 is placed over the coil 402. The magnetostrictive film may comprise a polymer film that includes a magnetostrictive material such as, but not limited to, Terfenol-D that is mixed with the polymer film. The magnetic field causes the magnetostrictive film 408 to change size in accordance with the frequency of the electrical signal.

Figure 5:
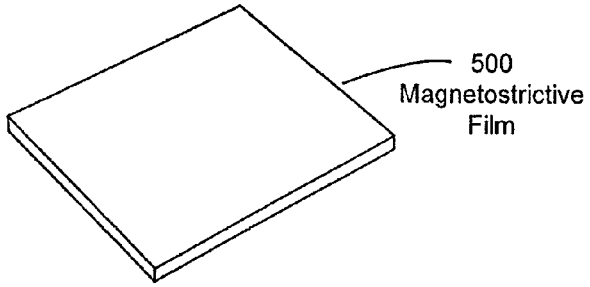
FIG. 5 is a schematic illustration of an embodiment of a magnetostrictive film.

FIG. 5 is a schematic illustration of an embodiment of a magnetostrictive film 500. As shown in FIG. 5, the magnetostrictive film 500 is thin. The magnetostrictive film 500 that is illustrated in FIG. 5 has a rapid response time in response to the magnetic field that is generated by the coil 402.

Figure 6:
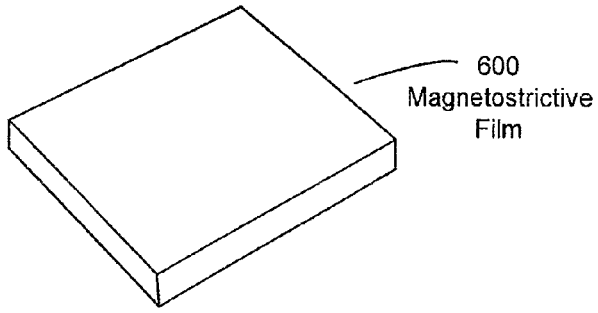
FIG. 6 is a schematic illustration of another embodiment of a magnetostrictive film.

FIG. 6 is an illustration of another embodiment of a magnetostrictive film 600. As shown in FIG. 6, the magnetostrictive film 600 is a thicker film than the magnetostrictive film 500 of FIG. 5. The magnetostrictive film 600 has a slower response time than the magnetostrictive film 500. In other words, there is a delay in the process of causing the magnetostrictive film 600 to change size in response to the magnetic field generated by the coil 402. A thicker coating on coils, traces or wires also may create a longer delay. Hence, a device, such as illustrated in FIG. 4, that uses magnetostrictive film 600 would have a longer response delay compared to a device, such as illustrated in FIG. 4, that uses the thinner magnetostrictive film 500 of FIG. 5.

Figure 7:
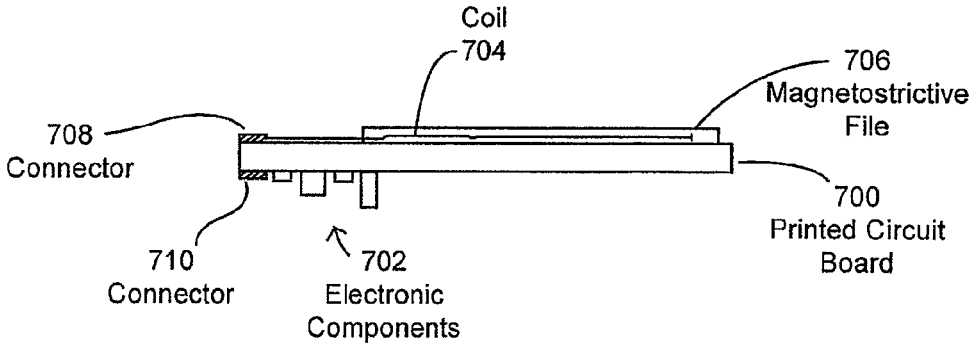
FIG. 7 is a schematic illustration of another embodiment of a printed circuit board device.

FIG. 7 is a schematic illustration of another embodiment that uses a printed circuit board 700 having a coil 704 formed from the printed circuit board leads. As shown in FIG. 7, a magnetostrictive film 706 covers the coil 704. The magnetostrictive film 706 may take various shapes and have various thicknesses when deposited on the printed circuit board. In addition, various mixtures and concentrations of magnetostrictive materials can be used. As also shown in FIG. 7, the electronic components 702 are disposed on an opposite side of the printed circuit board 700. The electronic component 702 can comprise various types of components including active filters, microprocessors, digital signal processors, amplifiers, and any other type of components used in hearing devices. A multi-layer printed circuit board may be used in this application to provide connections on an intermediate layer. Connectors 708, 710 provide connections to a battery pack or other power supply. In this fashion, an electronics package can be provided by the electronic components 706 that are disposed on the printed circuit board 700. Alternatively, the coil 704, magnetostrictive film 706 and the electronic components 702 can be mounted on the same side of the board. In any event, the electronic components 702 are mounted outside of the periphery of the coil 704, so as to minimize interference with the magnetic field that is generated by coil 704. Alternatively, the magnetostrictive film 706, illustrated in FIG. 7, may be deposited on a suspended diaphragm over the coil on the printed circuit board 700 to allow greater movement of the magnetostrictive film 706 and provide greater efficiency in the production of sound waves.

Figure 8:
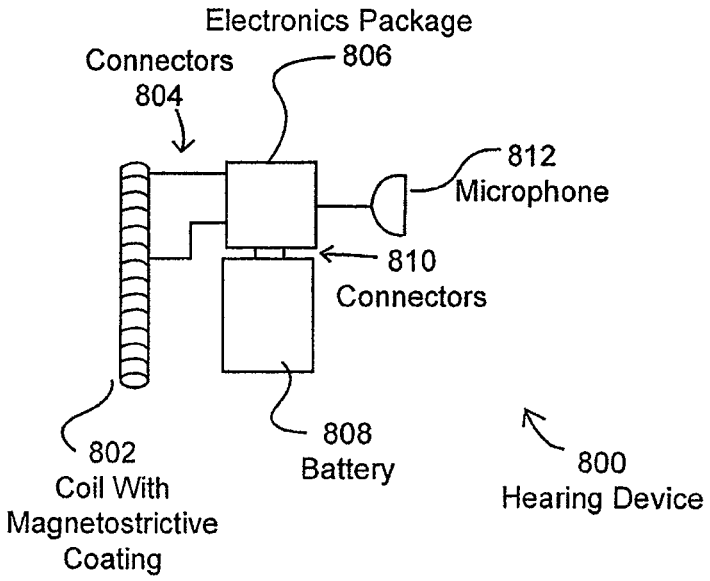
FIG. 8 is a schematic illustration of an embodiment of a hearing device.

FIG. 8 is a schematic illustration of a hearing device 800. The hearing device 800 may comprise a hearing aid or hearing aid receiver, collectively referred to as a hearing device, that can be a miniaturized hearing aid that is disposed either partially within, or fully within, the ear canal of a user. The size of the components allows for construction of the hearing device 800 that can be inserted in the ear canal. In that regard, the simplicity of the construction of the embodiment of FIG. 8 provides for a high degree of miniaturization. Further, the hearing device 800 of FIG. 8 can also be disposed in other types of hearing devices, such as ear phones, ear buds, telephones, speakers and other types of devices that generate auditory sound waves. As shown in FIG. 8, the coil 802 has a magnetostrictive coating, such as illustrated in FIGS. 1 and 2. Alternatively, the coil 802 may be wrapped with a magnetostrictive film that comprises a magnetostrictive material, such as Terfenol-D, that is impregnated in a polymer or other film material. Coil 802 is connected to the electronics package 806 via connectors 804. Electronics package 806 receives an auditory signal from the microphone 812, which is amplified by the electronics package 806 and applied via connectors 804 to the coil 802. Battery 808 is connected to the electronics package 806 via connectors 810 to provide power to the hearing device 800. The magnetostrictive material efficiently changes shape in response to a magnetic field that is generated by the current that is running through the coil 802. The thickness of the magnetostrictive coating, or the thickness of the film applied around the coil 802, determines the response of the magnetostrictive material to the current that is applied to the coil 802. The current that is applied to the coil 802 generates a magnetic field that varies with the number of coil windings of the coil 802. The auditory vibrations of the coil 802 generate sound and auditory vibrational waves that assist the user in hearing, understanding and enjoying auditory tones. Sound waves and auditory vibrations are efficiently produced in the magnetostrictive material because of the close contact of the magnetostrictive material with the coil 802. In addition, many harmonic frequencies are created because of the efficiency of the magnetostrictive coating in generating auditory vibrations. Again, this is due to the close proximity of the magnetostrictive coating to the wire of the coil 802. For hearing devices that are inserted in the ear canal, the auditory vibrations of the magnetostrictive coating on the coil 802 additionally assist the user in hearing tonal frequencies. A significantly improved hearing response is achieved using the magnetostrictive coating on the coil. The magnetostrictive material tends to create some noise, which may assist the user in hearing, as a result of the stochastic resonance. Stochastic resonance may aid the user in the detection and/or enhancement of the auditory signal for easier hearing, identification and enjoyment of the auditory signal. In addition, Barkhausen noise may also assist the user in hearing. Barkhausen noise is the result of a series of sudden changes in the size and orientation of ferromagnetic domains, or microscopic clusters of aligned atomic magnets, that occurs during a continuous process of magnetization and demagnetization. In other words, magnetization and demagnetization occurs in minute steps. This creates a clicking or crackling noise because of the discontinuous jumps in magnetization. This may assist the user in hearing, as a result of stochastic resonance.

Although inner hair cells are outnumbered approximately four to one by outer hair cells, the inner hair cells gather and transmit the majority of auditory information that reaches the cerebral cortex. Because the cilia of the inner hair cells are not attached to the tectorial membrane, stimulation of the inner hair cells most likely results from motion of the surrounding fluid and basilar membrane. Brownian motion of the inner hair cell bundles may provide an optimal noise level that enhances the sensitivity of the mechanical/electrical transmission to weak acoustic signals. The vibrations provided by the coil 802, as well as the strong magnetic field that is generated by the coil 802, may increase the movement of the fluid in the inner ear, which may increase the firing of the inner hair cells. Therefore, Brownian motion created by the embodiment illustrated in FIG. 8 may serve to provide a greater opportunity for signal transmission in a user's ear that has significant outer hair cell damage and inner hair cells intact. In addition, the coil 802 with the magnetostrictive coating efficiently creates harmonics of the base frequencies that are very beneficial to the enhancement of speech discrimination.

As disclosed in FIGS. 1 and 2, magnetostrictive coatings can be used that have different thicknesses and different phase and time delay responses. The constriction of two different hearing devices 800 can be accomplished using two different thicknesses of magnetostrictive coverings. Different thicknesses can be provided using a different number of layers of magnetostrictive material. In this fashion, a hearing device having the thicker magnetostrictive covering 102 will have a delayed response and a different phase.

Central auditory processing disorder (CAPD) is a condition in which the user has difficulty processing or interpreting auditory information in a less than optimal listening environment. Individuals with CAPD typically have normal hearing acuity, but are unable to efficiently process or interpret speech when placed in a minimally noisy environment. Children and adults with CAPD often report that they are confused or become flustered in busy, listening environments. In classroom environments, the workplace and social gatherings, these individuals often have difficulty and are confused by different verbal stimuli. CAPD may occur in persons with other disorders, such as autism, ADD/ADHD, sensatory integration dysfunction, learning disabilities, speech and language deficients, traumatic brain injury or other neurological conditions. CAPD may also appear as an isolated dysfunction. For children and adults with CAPD, there is evidence of binaural asynchronies (BAs) in their central auditory nervous system (CANS). Binaural asynchronies are synchrony disruptions (delay) in time of auditory input signals to the individual's ears. Efficient processing of acoustic information relies on binaural interaction or synchronization of auditory inputs between the two ears, which is accomplished by the central auditory nervous system in most individuals. For a person with a normal central auditory nervous system function, auditory input between the two ears is synchronized in time. However, for an individual with atypical central nervous system function, there are asynchronies of various magnitudes that hinder efficient auditory processing of acoustic information.

By introducing a delay in the auditory signals that are processed by the hearing device 800 by using different thicknesses of magnetostrictive coverings, binaural asynchronies can be reduced or eliminated, and users can more effectively distinguish and understand auditory signals. This is a result of the fact that the magnetostrictive coverings 102, 202 can be used to introduce a delay in one of the ears, which may assist the user in synchronizing auditory signals. Proper delay by using different thickness of magnetostrictive materials can be established empirically. The delay can also assist users having other neurological disorders, such as traumatic brain injury, ADD/ADHD, Parkinson's disease, multiple sclerosis, autism, gross/fine motor disorders, oral-motor disturbances, visual processing, tinnitus, etc.

Delay of the sound signal can also be assisted by employing the concepts of the invention in an ear canal device that has a duct that changes the propagation length of the sound for each individual ear, or for one ear. In other words, concepts of the various embodiments may be employed in the ear hearing device such that propagation lengths are different for each ear, or for one ear. Passive delay devices can be used separately or in conjunction with the various embodiments disclosed herein. Passive delay devices are more fully disclosed in U.S. patent application Ser. No. 11/443,859, filed May 31, 2006, entitled "Apparatus and Methods for Mitigating Impairments Due to Central Auditory Nervous System Binaural Phase-Time Asynchrony," which is specifically incorporated herein by reference for all that it discloses and teaches.

Comprehension of auditory signals using hearing devices can be negatively impacted by electromagnetic interference. A multi-coil winding 300, such as shown in FIG. 3, that has a magnetostrictive covering 102, or a magnetostrictive film 408 over a coil 402, as shown in FIG. 4, is believed to reduce electromagnetic interference. For example, appliances that use a large amount of current, such as a computer monitor, television or other similar device, may create interference in a hearing device because of the electromagnetic interference of the electrical power signal applied to the appliance. Many hearing aids are constructed using a moving coil apparatus, or a balanced armature apparatus. Each of these devices may function as antennas that pick up the electromagnetic interference that is converted by the hearing device into an auditory hum that is transmitted to the user's ear. This may also be the case with electrostatic type of drivers that use electrically charged diaphragms. The embodiments disclosed herein are believed to reduce the electromagnetic interference and provide a high spectral response that aids users in hearing auditory signals. Use of magnetostrictive covering on loop systems that interact with a T coil system in a hearing aid or other hearing device, may result in less electromagnetic interference. Another possible source of interference that is encountered in standard hearing devices, and not encountered in the embodiments disclosed herein, is interference from magnetic fields. Many standard hearing devices operate by using a moving coil mechanism in which a moving coil is attached to a diaphragm that is exposed in a static magnetic field generated by a permanent magnet. Variations of the current that is applied to the coil causes the coil to generate a magnetic field that interacts with the static magnetic field and causes the coil to move on the diaphragm. In this fashion, sound waves are produced. Various electronic devices generate magnetic fields that perturb the static magnetic field of the permanent magnet in the hearing device. These perturbations in the static magnetic field create interference in the hearing device. None of the embodiments disclosed herein utilize a static magnetic field that can be perturbed by magnetic fields generated by various electronic devices. As a result, interference by magnetic field waves does not occur in the embodiments disclosed herein.

Figure 9:
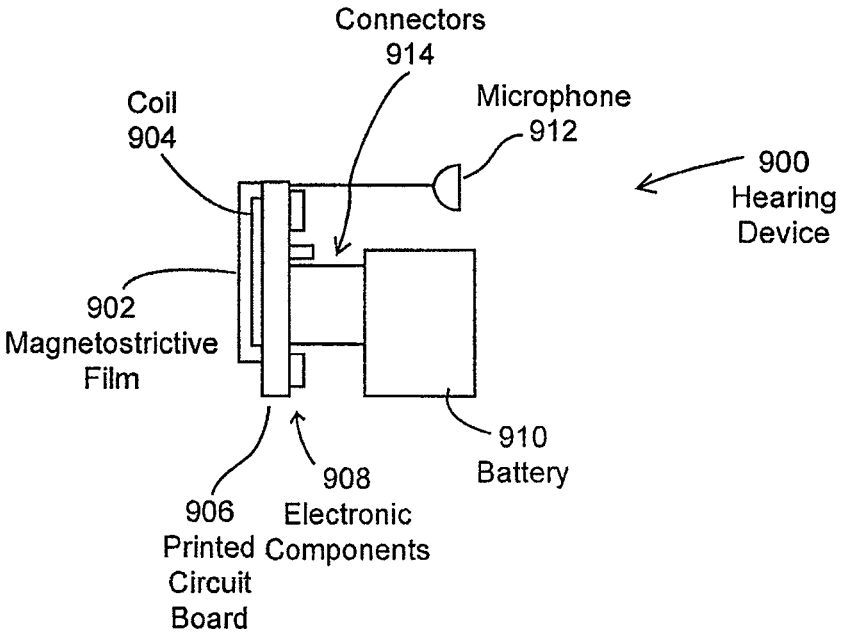
FIG. 9 is a schematic illustration of another embodiment of a hearing device.

FIG. 9 is a schematic illustration of another embodiment of a hearing device 900. Hearing device 900 is a device that is also amenable to miniaturization because of its compact size. As shown in FIG. 9, a magnetostrictive film 902 is deposited over coil 904. Coil 904 is a coil that may be made from the printed circuit board traces of printed circuit board 906. Electronic components 908 may be disposed on the other side of the printed circuit board 906 from coil 904 or on the same side. Electronic components 908 may be disposed around the periphery of the printed circuit board, or to one side of the circuit board, so that the magnetic waves generated by the coil 904 are not interrupted by the electronic components 908. The printed circuit board 906 and the electronic components 908 are connected to a microphone 912 that detects auditory signals. These auditory signals are amplified and applied to the coil 904. Current in the coil 904 generates a magnetic field that causes the magnetostrictive film 902 to change size and generate auditory vibrations. The auditory vibrations of the magnetostrictive film 902 produce sound waves that are efficiently transmitted to the user. In addition, the auditory vibrations of the magnetostrictive film 902 may be transmitted through the tissue in the user's ear to further assist in hearing and comprehension. Battery 910 supplies power to the electronic components 908 on the printed circuit board 906 via connectors 914.

The hearing device 900, illustrated in FIG. 9, may be a hearing aid that is disposed in the outer ear, headphones, a telephone, a speaker or many other types of hearing devices. Since the magnetostrictive film 902 is placed directly over the coil 904, a high degree of efficiency is achieved in generating auditory vibrations. As a result, multiple harmonic frequencies are generated, which also assists the user in comprehending the auditory signals detected by the microphone 912. Of course, some auditory frequencies may be amplified to a greater extent than others, in accordance with the standard practice of designing a hearing device for a particular user. In general, however, the efficient operation and generation of multiple harmonic frequencies, as well as the generation of stochastic resonances by both hearing device 800 and hearing device 900, greatly increases the auditory comprehension and audibility, understanding and enjoyment by the user. Of course, the various embodiments disclosed herein can be disposed in any type of hearing device including headphones, speakers, ear pods, ear buds, etc. and could be used by individuals who do not have hearing loss and do not have hearing comprehension problems, but, rather, like to enjoy an audio response and take full advantage of the attributes of various embodiments disclosed herein. Further, each of the devices disclosed herein can be encapsulated in a standard package for connection to a device such as a headphone, speaker, etc. In that regard, the encapsulated packages can be sold as modular devices that can be employed in any desired fashion, such as any type of hearing device, including hearing aids, headphones, speakers, etc.

Figure 10:
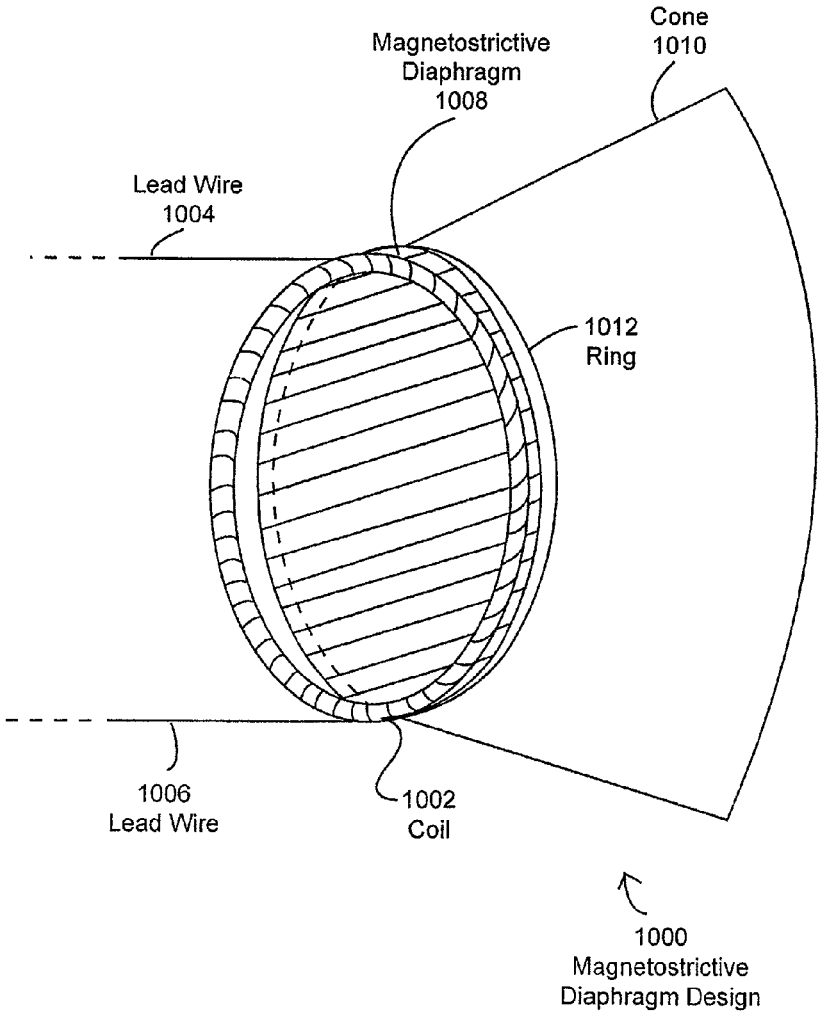
FIG. 10 is a perspective view of another embodiment.
Figure 11:
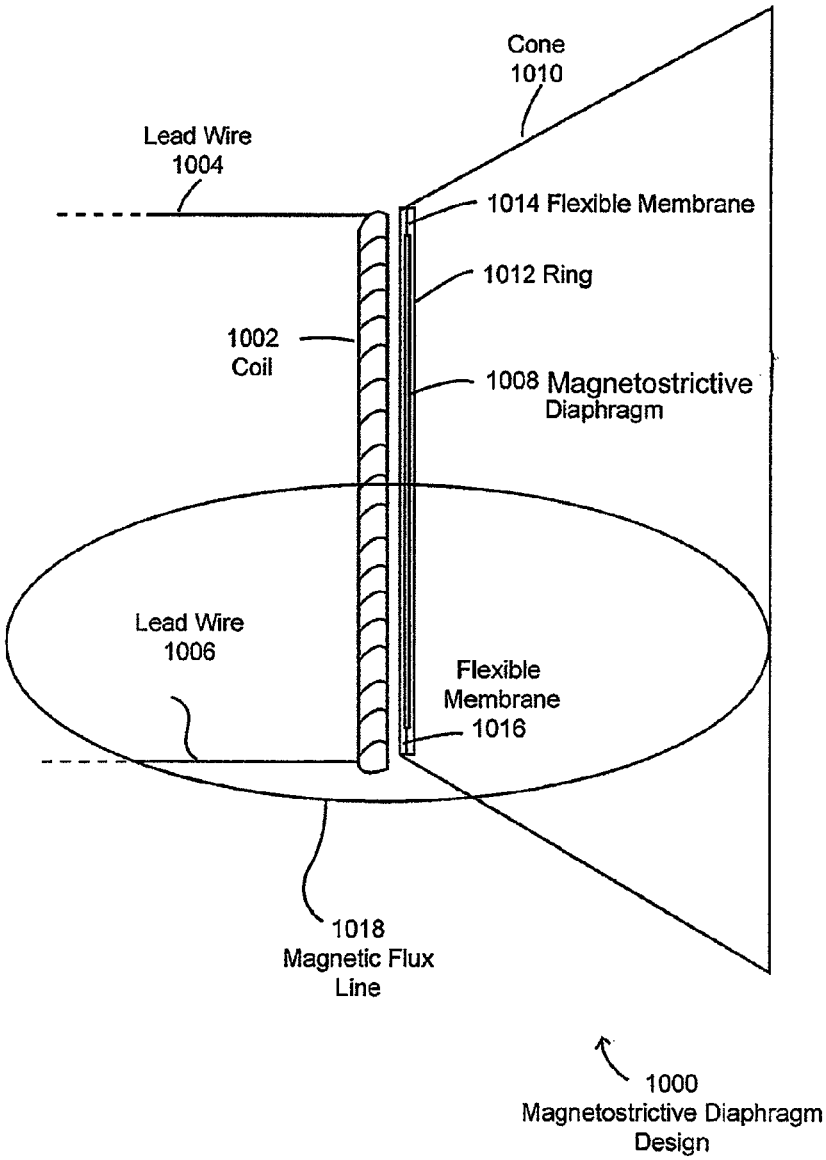
FIG. 11 is a side view of the embodiment of FIG. 10.

FIGS. 10 and 11 disclose a magnetostrictive diaphragm design for hearing devices. FIG. 10 is a perspective view of the magnetostrictive diaphragm design 1000, while FIG. 11 is a side view. As shown in FIG. 10, coil 1002 is attached to lead wires 1004, 1006 that apply electrical signals to the coil 1002 that are representative of auditory signals. The coil 1002 may comprise a conductive wire such as conductive wire 200 that is surrounded by magnetostrictive covering 2002. Alternatively, coil 1002 may be wrapped in a magnetostrictive film or over-molded with a magnetostrictive plastic over-molding. Further, coil 1002 may contain no magnetostrictive materials. Coil 1002 is placed adjacent a ring 1012, as disclosed in both FIGS. 10 and 11. Ring 1012 is a support ring that supports a magnetostrictive diaphragm 1008 that is suspended from the ring by a flexible membrane 1014. Magnetostrictive diaphragm 1008 can be formed from a thin polymer or plastic material that is embedded or mixed with magnetostrictive materials. Cone 1010 is an optional feature that can be used to direct the audio signals that are generated by the magnetostrictive diaphragm 1002.

In operation, the coil 1002 of FIGS. 10 and 11 generates a magnetic field that varies with the application of the electrical signal that is applied to lead wires 1004, 1006. The magnetic field penetrates the coil and the magnetostrictive diaphragm 1008 as shown by the exemplary magnetic flux line 1018. As the magnetic field generated by the coil 1008 varies in response to the electrical signal applied to lead wires 1002, 1006, the magnetostrictive materials change size which causes diaphragm 1008 to move and push the surrounding air to create sound waves. In other words, the magnetostrictive diaphragm 1008 includes magnetostrictive materials that change size in the magnetic field created by the coil 1002 and cause the magnetostrictive diaphragm 1008 to move response to the magnetic field. In addition, Ferrofluid, which is produced by Ferrotec Corporation, can also be coated on the magnetostrictive diaphragm 1008 to further assist in driving the magnetostrictive diaphragm 1008. Ferrofluid is available from Ferrotec Corporation located in Bedford, N.H., and San Jose, Calif.

Figure 12:
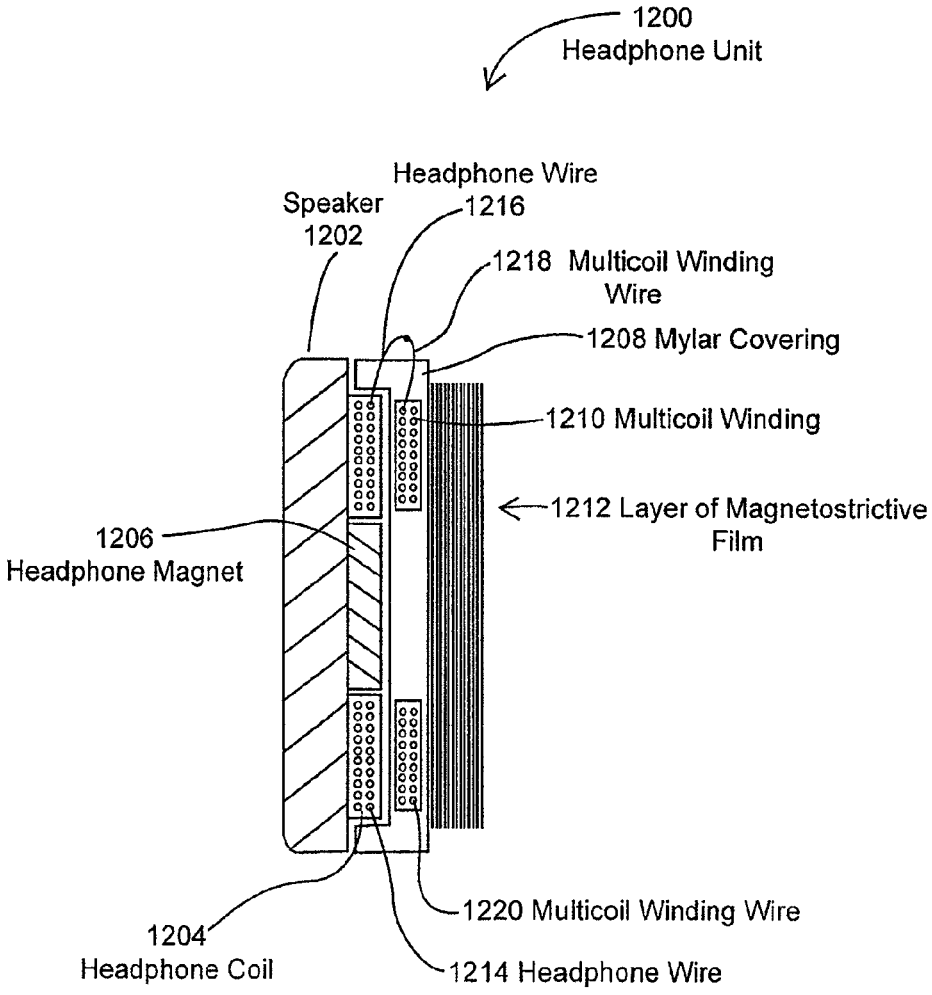
FIG. 12 is a cutaway view of another embodiment.

FIG. 12 is a cutaway view of an embodiment of a headphone unit 1200. As shown in FIG. 12, the headphone unit 1200 includes a speaker 1202, a headphone coil 1204 and a headphone magnet 1206. These are the standard components that are found in typical headphones. As also shown in FIG. 12, a multi-coil winding 1210 is embedded in a mylar covering 1208 and placed over the rear portion of the headphone unit adjacent the headphone magnet 1206 and the headphone coil 1204. The mylar covering 1208 can be friction fit to the back of the headphone unit or can be attached by other mechanical means, such as by adhesives, etc. A plurality of layers of magnetostrictive film 1212 are then placed over the mylar covering 1208 and the multi-coil winding 1210. The magnetostrictive film may comprise a polymer that is mixed with particles of magnetostrictive material. In one embodiment, each layer of magnetostrictive film has a thickness of 1 mil. The headphone wire 1216 that is attached to the headphone coil 1204 can be clipped and attached to multi-coil winding wire 1218. Multi-coil winding wire 1220, which is at the other end of the multi-coil winding 1210, can then be connected to the drive source for the headphone unit 1200. The headphone wire 1214, which is at the other end of the headphone coil 1204, can remain attached to the driving source. In this manner, multi-coil winding 1210 is placed in series with the headphone coil 1204.

The headphone unit 1200 that is illustrated in FIG. 12 provides excellent speech discrimination for both hearing impaired users and users with no hearing loss. Tests on similar headphones are described below, which show increased speech discrimination using similarly modified headphone units. Of course, any type of auditory speaker system can be modified in this manner, including headphones that are used in telephones, ear pods, hearing aids, speakers and similar devices. The multiple layers of magnetostrictive film 1212 also assist in blocking electromagnetic interference, which may be generated by noisy appliances, computers, cell phones, etc.

Tests were performed using headphones that have been modified by placing a magnetostrictive polymer film over the headphone coil similar to the embodiment of FIG. 12. Groove headphones, model TM-707v, available from Groove Industries Co. Ltd, Rm703 A, Huangdu Plaza, Yitian Rd, Futian, Shenzhen, China, were modified to determine speech discrimination. The ear assembly cover of the headphone was pried open to expose the speaker assembly. A circle of thin black foam padding was removed and eight pieces of 1 MIL amorphous magnetostrictive film, that were cut into 11/16" squares, were stacked together and enclosed with electrical tape. The stacked pieces were then taped to the speaker assembly of the headphone with a metal assembly placed on top of the tape strip. A 100 turn, 36 G wire coil assembly was then placed on top of the metal layers. The red wire from the speaker was then removed and one end of the coil was attached to the speaker where the red wire was removed. The other coil wire was then attached to the red wire that was removed from the speaker. The earpiece assembly was then reassembled and the other earpiece was modified in the same manner.

Subjects were tested to determine potential benefit from the retrofitted headphones. Speech discrimination measurements were made with both the modified headphones and unmodified headphones in both quiet and noisy environments. One of the most challenging areas for audio and assistive devices for those with hearing loss involves the enhancement of speech understanding in the presence of noise. Understanding speech in noise continues to be the most prevalent complaint of individuals using hearing aids. Designing affordable and easily embedded technology in various audio systems, such as headphones, telephones and hearing aids to address enhancement of speech understanding in noisy environments provides great assistance to many individuals.

The subjects in the testing of the modified headphones were 83 native English speaking male and female subjects from eight years to adult. Participants were recruited from Northern Colorado. The 83 participants were broken into the following groups: 1) normal hearing; 2) hearing loss; 3) central auditory processing disorder. All participants were separated into these groups based upon their pure tone findings and, for those included in the central auditory processing disorder group, by simple auditory processing testing. Participants with hearing loss had hearing thresholds span levels of impairment from a mild degree through profound. Various types of hearing loss and configurations of impairment were included in the study.

The participants were evaluated using strict audiologic controls. All audiologic testing procedures were conducted in a double walled, IAC, soundproof room. A Grason-Stadler (GSI-61) diagnostic audiometer was used to present test items to participants via TDH-50 electrodynamic earphones (10 ohm, mounted in MX/41 AR cushions). The audiometer was calibrated in accordance with ANSI (1989 S3.6) specifications before the collection of data. Speech stimuli for monosyllabic word testing was played on a CD player and passed through the speech circuit of the GSI-61 diagnostic audiometer. Speech reception thresholds (SRT) were established using the W-1 CID Spondee word list, and speech discrimination scores in quiet were obtained using Campbell's word lists. Campbell's word lists are standardized and are commonly used in auditory studies. The pattern of each monosyllabic word was of the consonant-vowel-consonant type. Impedance audiometry was also performed using the Grason-Stadler, Model TympStar impedance unit. Tympanometry was administered for both ears. Three targeted headphones (TH-50 Groove, Model 707 non-retrofitted headphone, Groove, Model 707 retrofitted headphone) were introduced during the final phase of testing. These included standard diagnostic TDH-50 headphones, Groove, Model 707, headphones and Groove, Model 707, retrofitted headphones with new hearing technology. All headphones were calibrated according to ISO (1964) and ANSI (1969) standards. Correction factors were employed throughout testing for each headphone to maintain consistency in output for all headphones and test stimuli. NU-6 phonetically balances word list (Tillman & Carhart 1966) (Lists A1, A2, A4, B1, B2 and B4) were used to determine single words speech discrimination scores in noise. These words were presented via a CD player using a CD recorded by Auditec of St. Louis. Words were presented through the targeted headphones via the Grason-Stadler, Model GSI-61, diagnostic audiometer. These words were presented at 40 dB SL re pure tone average with signal-to-noise ratio of +6 using speech band noise presented ipsilaterally. These word lists are standardized and are commonly used in auditory studies. The pattern of each monosyllabic word was of the consonant-vowel-consonant type. Results of this testing are shown in FIGS. 13 and 14.

Figure 13:
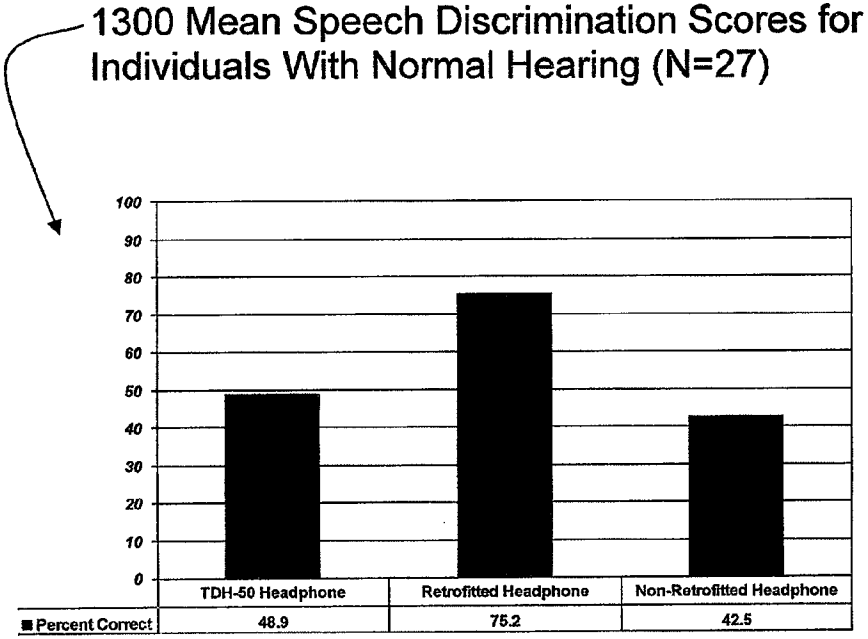
FIGS. 13-24 are graphs of test results.

FIG. 13 is a graph 1300 of the mean speech discrimination scores in noise for individuals with normal hearing using three different headphones. As shown in FIG. 13, the retrofitted headphones provided much better speech discrimination for users with normal hearing.

Figure 14:
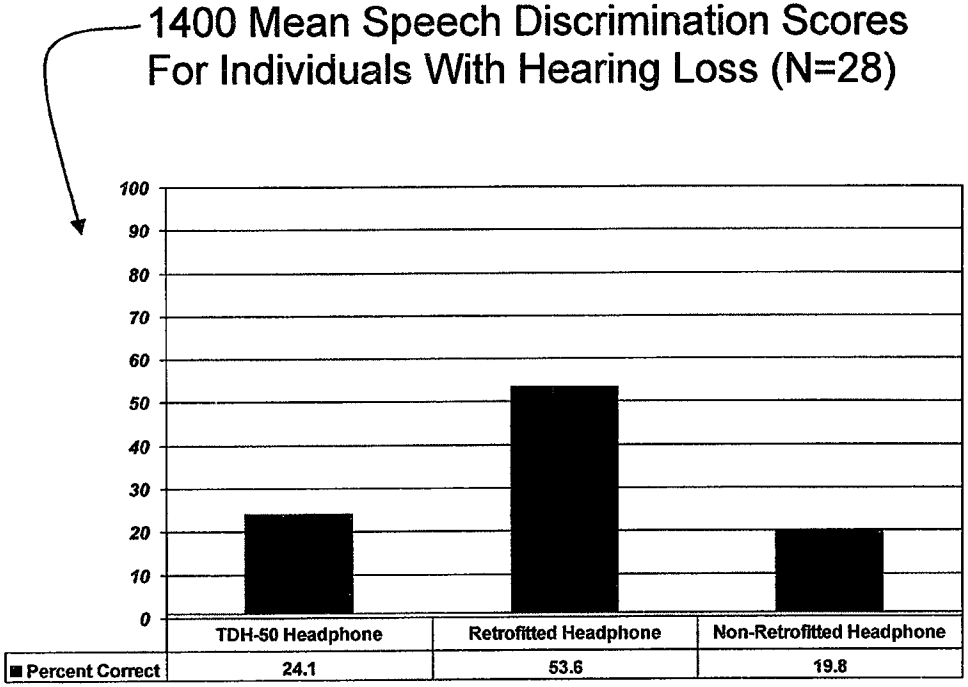

FIG. 14 is a graph 1400 of the mean speech discrimination scores in noise for individuals with hearing loss using three different headphones. As shown in FIG. 14, the retrofitted headphones provided much greater speech discrimination for users with hearing loss.

Figure 14A:
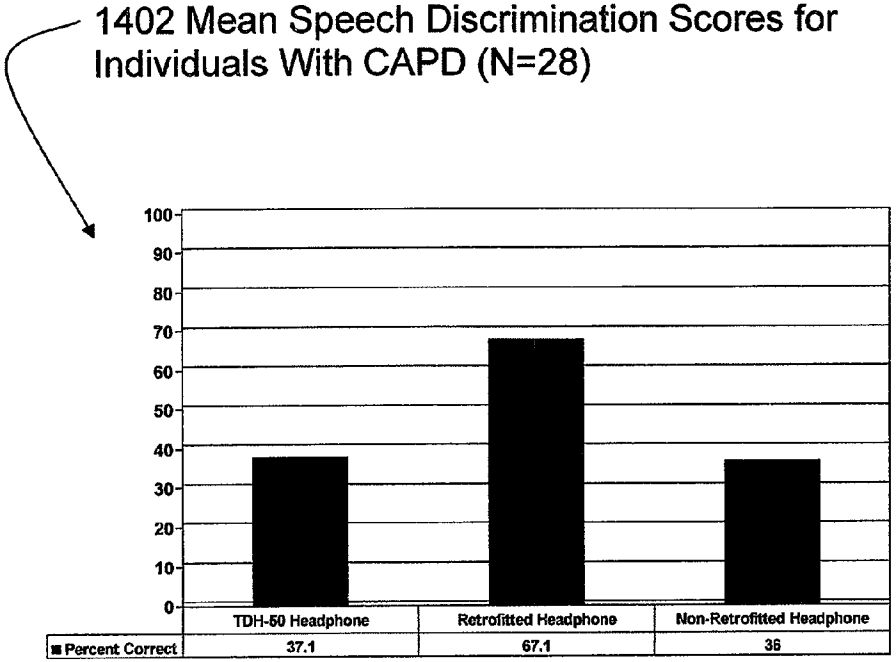

FIG. 14A is a graph 1402 of the mean speech discrimination scores for individuals with CAPD using three different headphones. As shown in FIG. 14A, the retrofitted headphones provide a much greater speech discrimination for users with CAPD.

Figure 15:
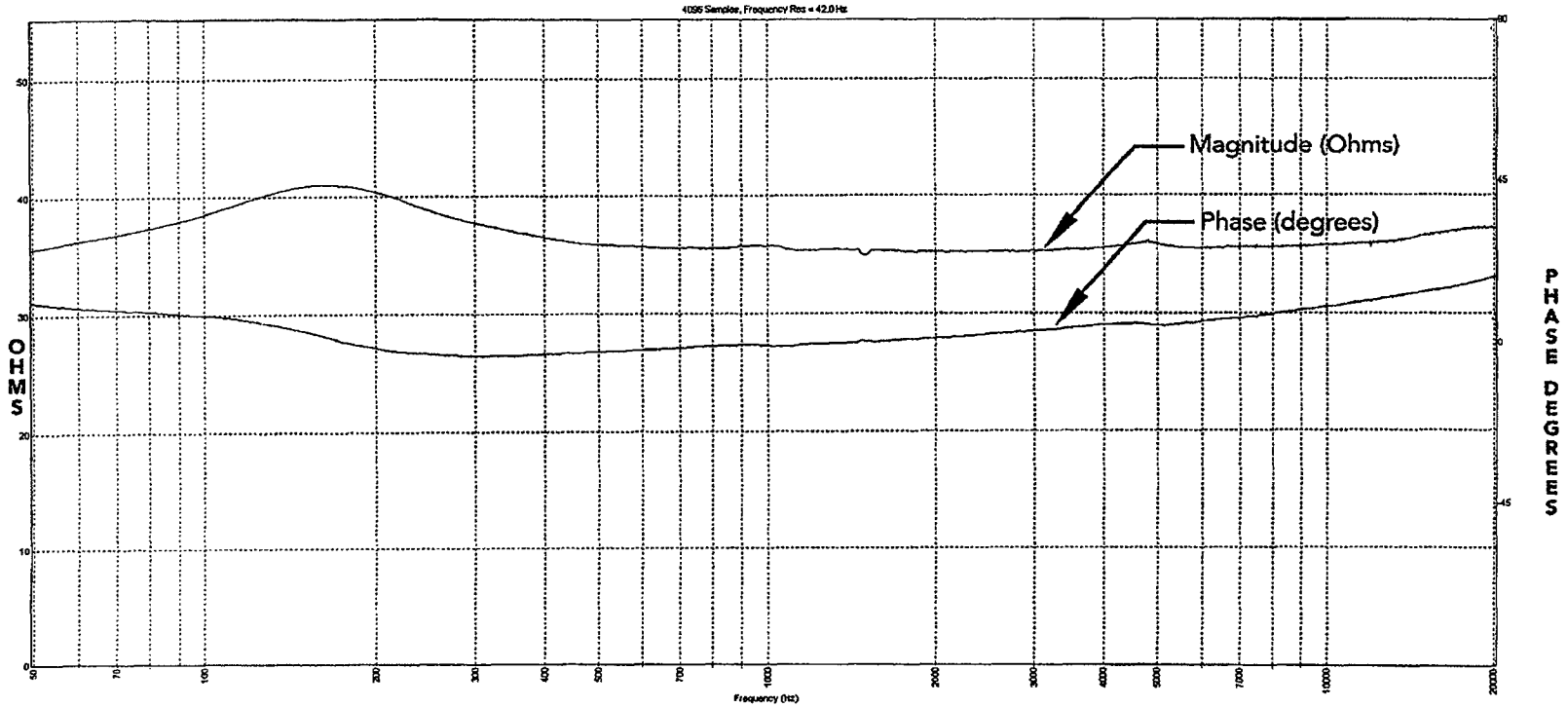
Figure 16:
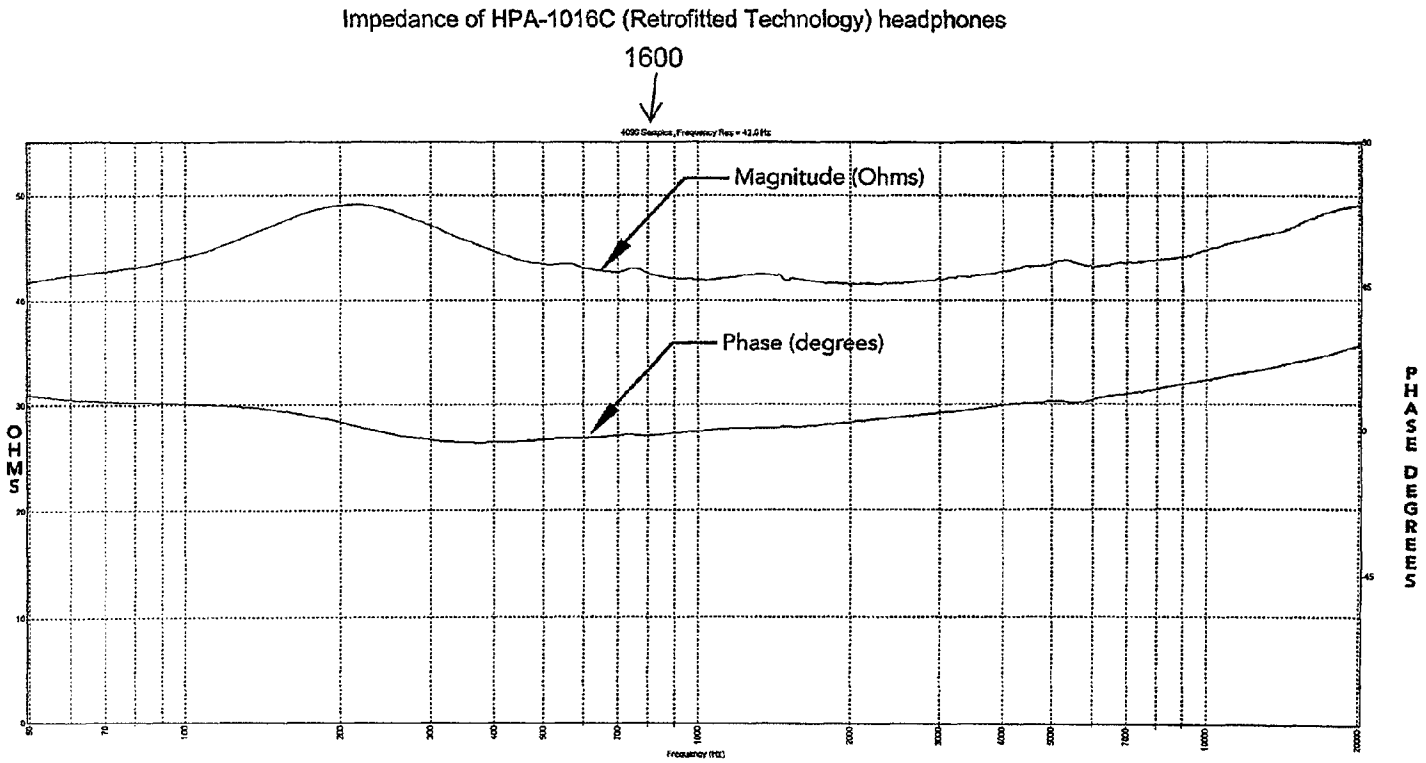
Figure 17:
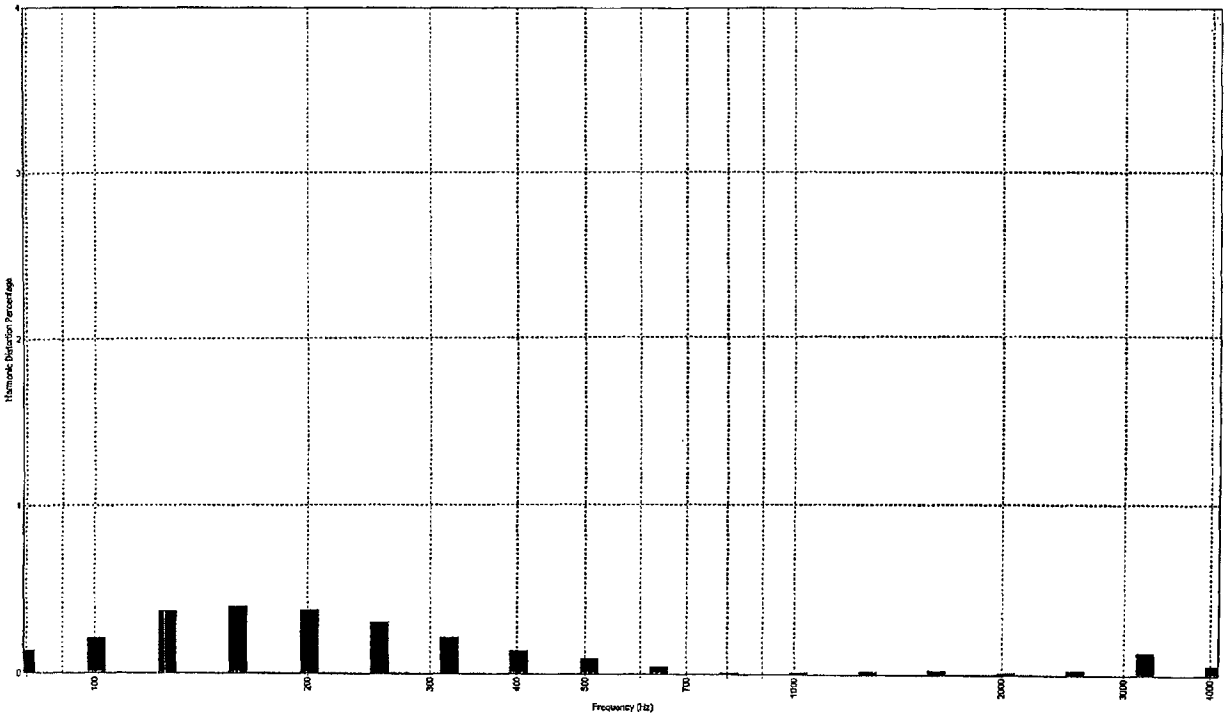
Figure 18:
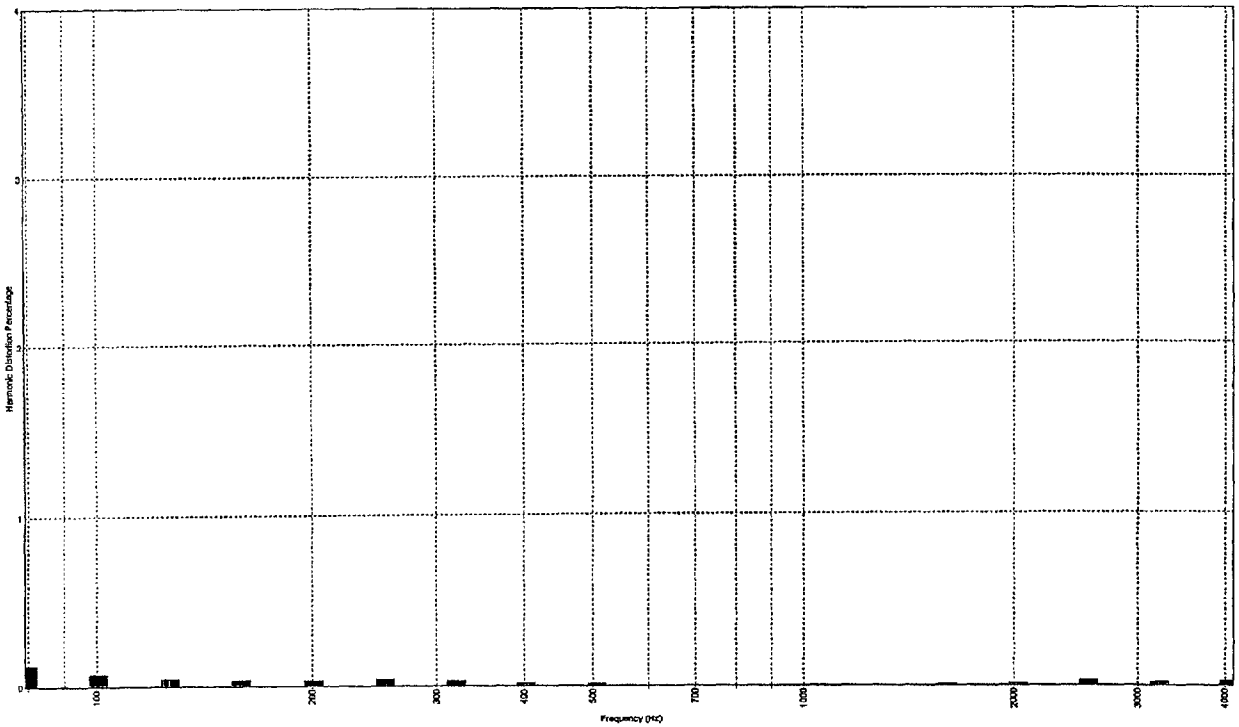
Figure 19:
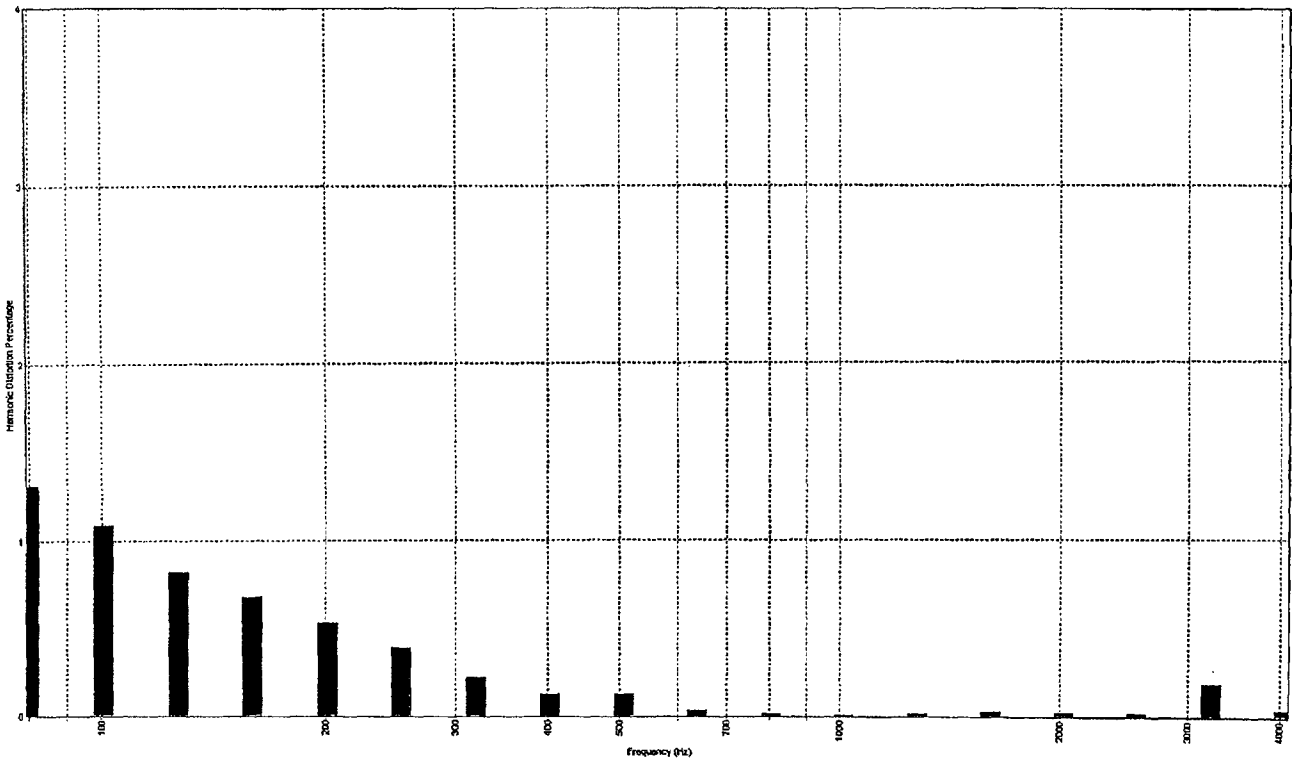
Figure 20:
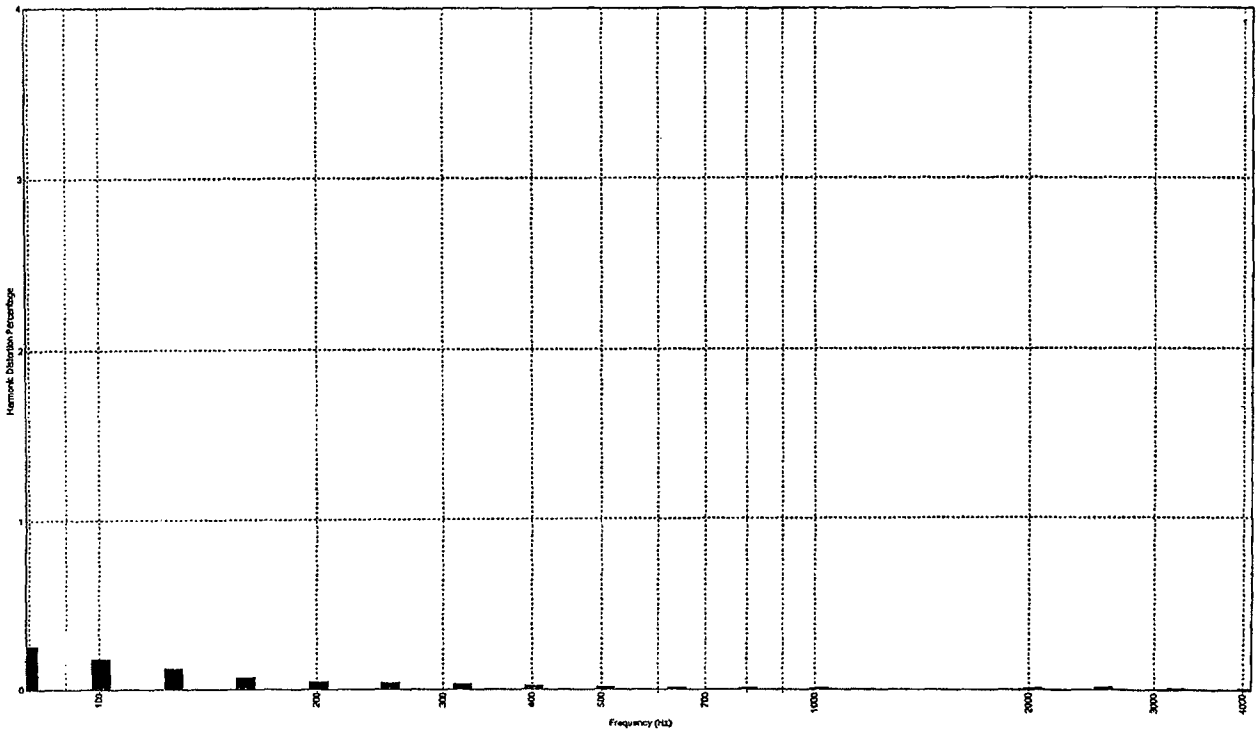
Figure 21:
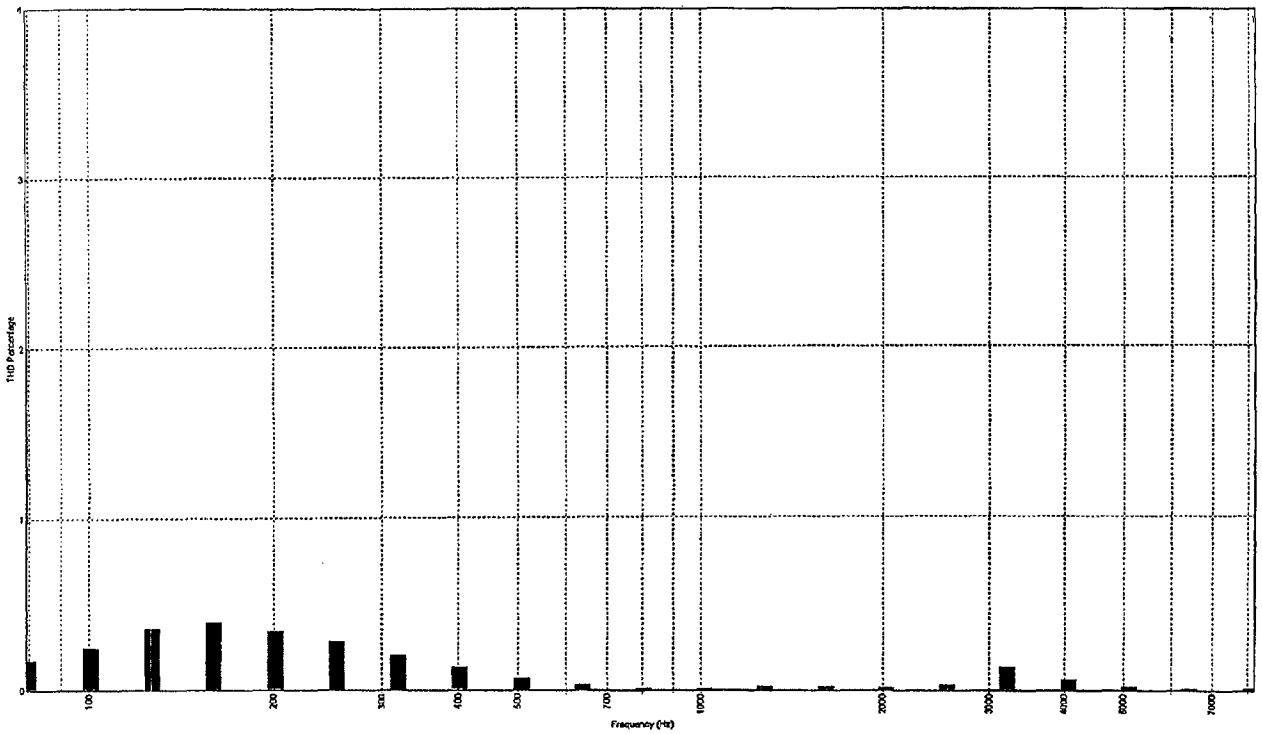
Figure 22:
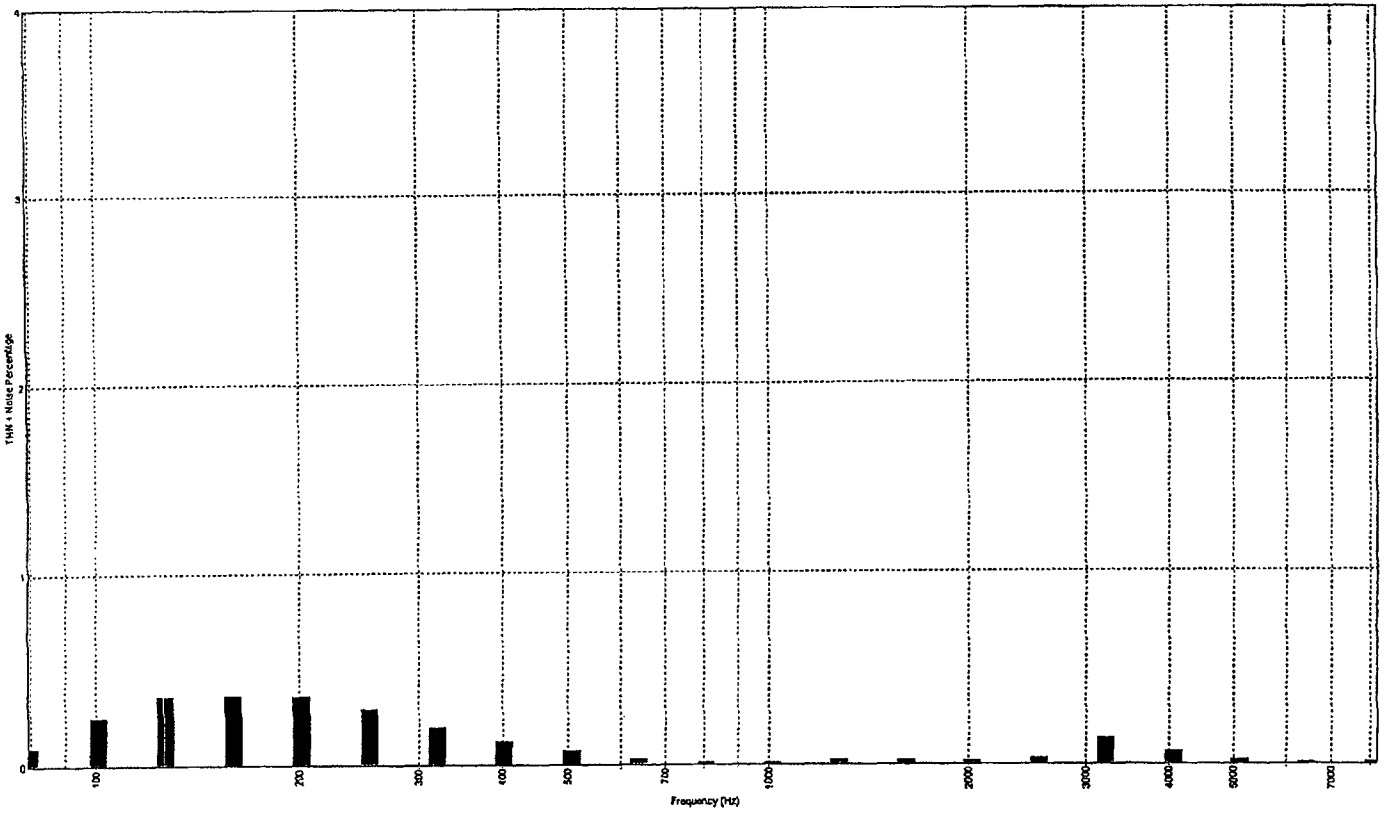
Figure 23:
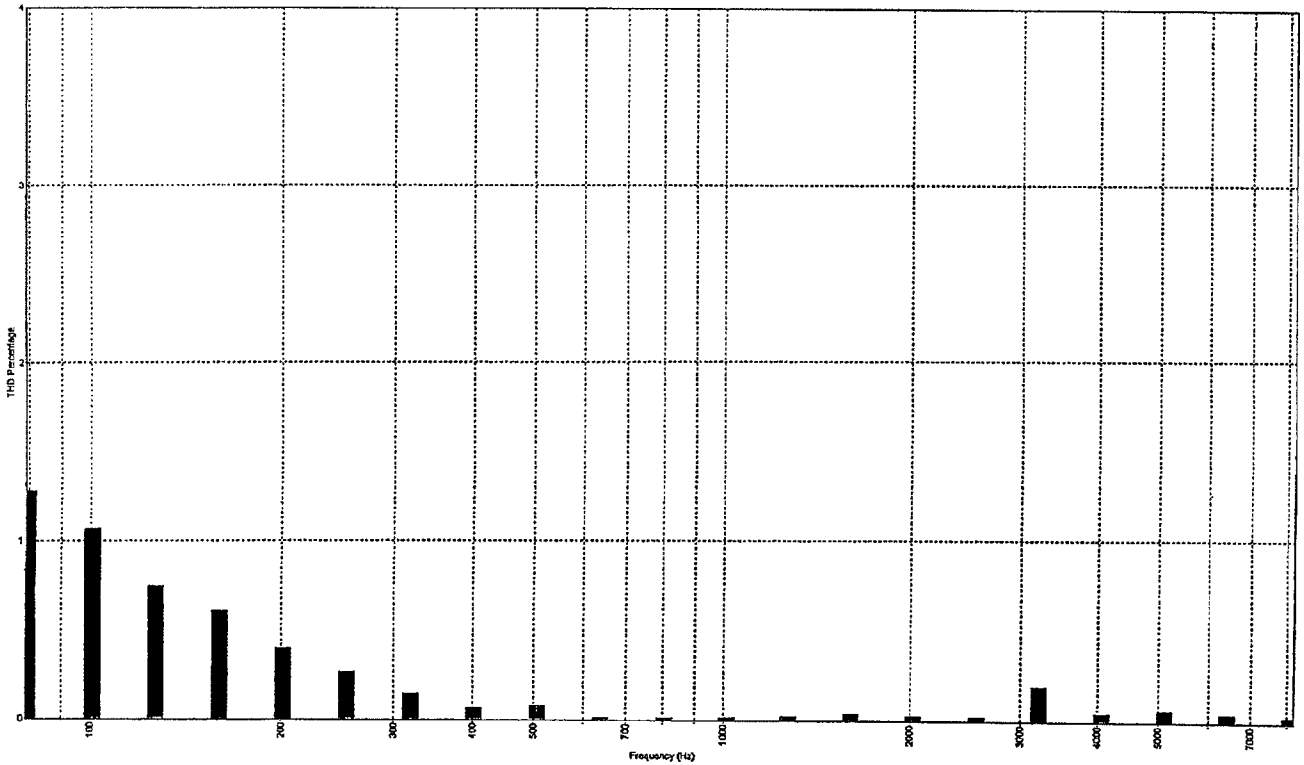
Figure 24:
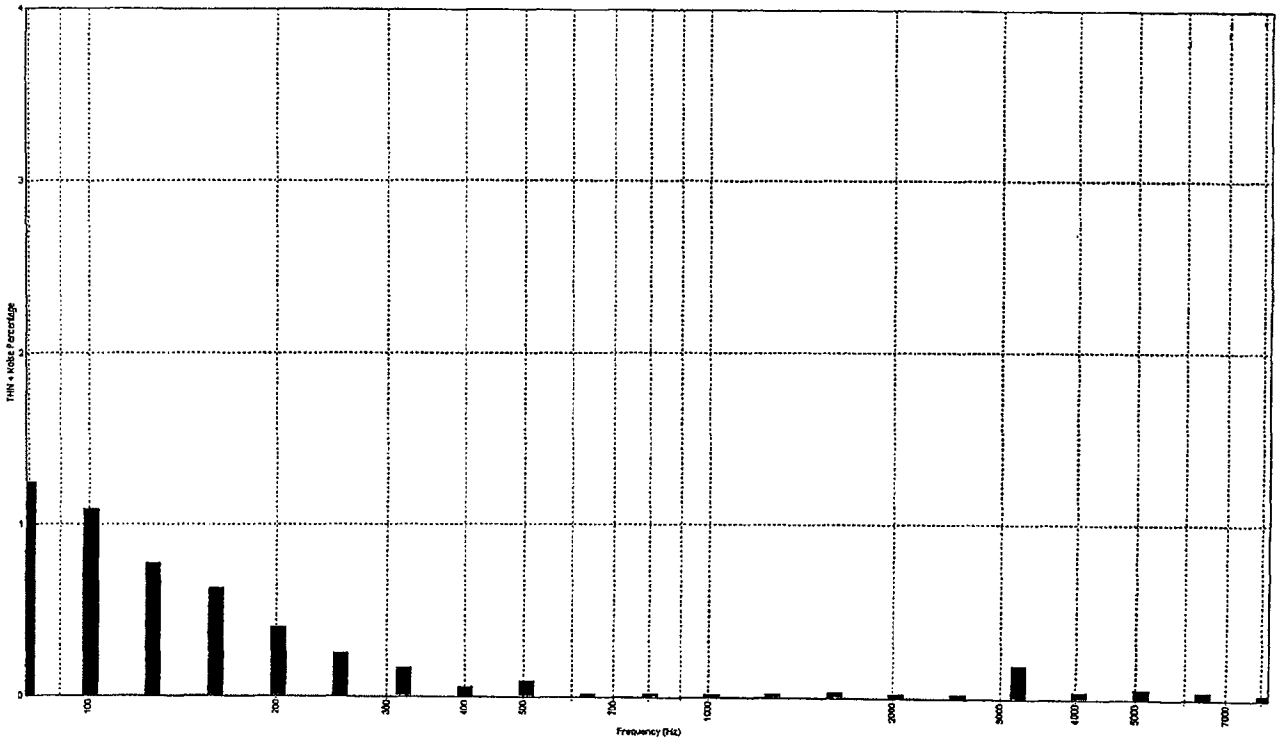

FIGS. 15-24 are graphs of additional test results on the HPA-1000C non-retrofitted headphone and the HPA-1016C retrofitted headphone. FIGS. 15 and 16 show impedance measurements of the headphones versus frequency. FIG. 15 is a graph 1500 of the impedance of an HPA-1000C headphone that is not retrofitted. FIG. 16 is a graph 1600 of the impedance of an HPA-1016C headphone with the retrofitted technology. The impedance measurements are of interest since these graphs show how much of a load each headphone places on the circuit driving the headphone. The lower the impedance of the headphone, the greater the load on the driving circuit. FIG. 17 is a graph 1700 that shows the second and fourth even order harmonic distortion of the HPA-1000C headphones that have not been retrofitted using a 63 mV drive. FIG. 18 is a graph 1800 that shows the third and fifth odd order harmonic distortions of the HPA-1000C non-retrofitted headphones using a 63 mV drive. FIG. 19 is a graph 1900 that shows the second and fourth even order distortion of the HPA-1016C retrofitted headphones, using a 63 mV drive. As shown in FIG. 19, the harmonic distortion of the even orders is much greater for the retrofitted headphones than the even order distortion illustrated in FIG. 17. FIG. 20 is a graph 2000 that shows the third and fifth odd order harmonic distortion of the HPA-1016C retrofitted headphones using a 63 mV drive. FIG. 20 shows much larger harmonic distortions for the retrofitted headphones than the non-retrofitted headphones, for the third and fifth odd order harmonics, illustrated in FIG. 18. FIG. 21 is a graph 2100 of the total harmonic distortion of the HPA-1000C non-retrofitted headphones using a 63 mV drive. FIG. 22 is a graph 2200 of the total harmonic distortion plus noise of the HPA-1000C non-retrofitted headphones using a 63 mV drive. FIG. 23 is a graph 2300 of the total harmonic distortion of the HPA-1016C retrofitted headphones using a 63 mV drive. As shown in FIG. 23, there is substantially greater total harmonic distortion of the retrofitted headphones than that illustrated in FIG. 21, especially at lower frequencies. FIG. 24 is a graph 2400 of the total harmonic distortion plus noise of the HPA-1016C retrofitted headphones using a 63 mV drive. Again, there is a substantially larger amount of total harmonic distortion illustrated in FIG. 24, as compared to that shown in FIG. 22, especially at lower frequencies. Hence, these tests illustrate that harmonic distortion is increased with the modified headphones which may assist in the process of speech discrimination. All of the measurements were made with a gold-Line TEF 25 analyzer. Level calibration was performed by a Bruel & Kjaer 4231 calibrator. Acoustic measurement was performed by a General Radio (GenRad) 1560-T83 earphone coupler with a 1987-2050 adapter. The microphone used was a Sound First SF111 Type 1 microphone. The headphones were driven by a Whirlwind PA-1 headphone amplifier set for unity gain. The headphone amplifier has an output impedance of 10 ohms.

Figure 25:
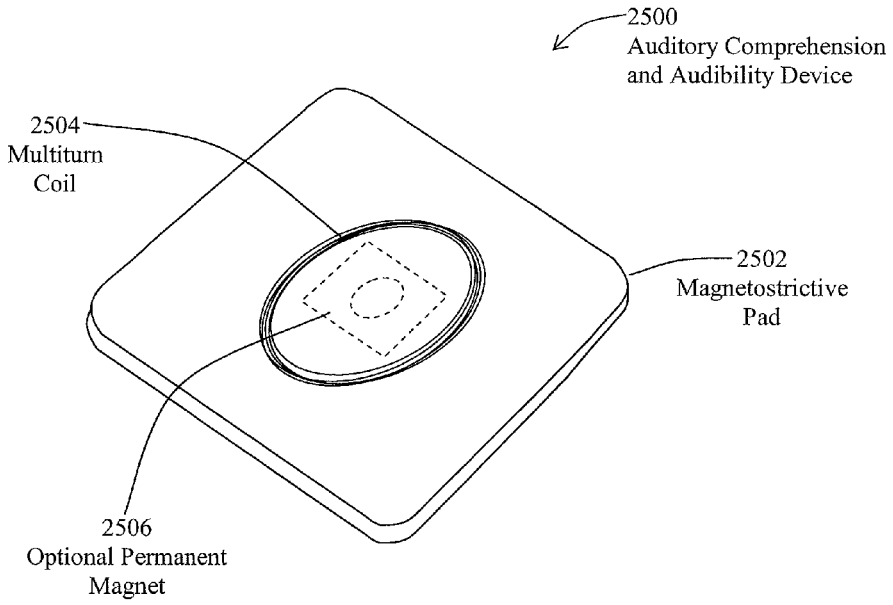
FIG. 25 is a schematic perspective view of an embodiment of an auditory comprehension and audibility device.

FIG. 25 is a schematic perspective view of an embodiment of an auditory comprehension and audibility device 2500. Speech discrimination is a measure of how well a person can understand what is heard when the auditory signal is sufficiently loud to hear comfortably. Audibility is a measure of the ability to hear in terms of loudness and signal to noise ratio. For example, audibility relates to the magnitude of an auditory signal with respect to background noise which may be created by electromagnetic interference. As illustrated in FIG. 25, a magnetostrictive pad 2502 is a pad made from any desired type of magnetostrictive material including Tefenol-D. A multi-turn coil 2504 is disposed on the surface of the magnetostrictive pad 2502. The multi-turn coil 2504 is a coil of wire that is looped around in a circular shape or other desired shape to form multiple turns around an open area in the middle of the multi-turn coil 2504. The wire used to form the multi-turn coil 2504 is insulated so that the wires do not form a short circuit but allow current to flow in the coil. The multi-turn coil 2504 may be connected together at its ends. Wire such as used in wrapping transformers and electric motors can be used in multi-turn coil 2504. A suitable number of turns for the multi-turn coil windings 2504 ranges from 5 to 500 or more. The magnetostrictive pad 2502 can have a thickness, which ranges from 0.1 mm to 50 mm or more.

The magnetostrictive pads disclosed herein can be fabricated from a series of thin films of magnetostrictive material. The magnetostrictive pad 2502 can be formed in any desired shape including rectangular, circular, triangular, etc. Alternatively, the magnetostrictive pad 2502 may be formed in a shape that matches the implementation of the auditory comprehension and audibility device 2500.

As also illustrated in FIG. 25, an optional permanent magnetic 2506 can be disposed beneath the auditory comprehension and audibility device 2500. The optional permanent magnetic 2506 may provide greater audibility as a result of magnetic coupling between the auditory comprehension and audibility device 2500 and a speaker, as disclosed in more detail below. As used herein, the term "speaker" may comprise any device that transforms an electrical signal into an audible signal, including speakers, ceramic vibration devices, etc. The permanent magnet 2506 may comprise any desired type of permanent magnetic, including rare earth permanent magnets that create strong magnetic fields.

Figure 26:
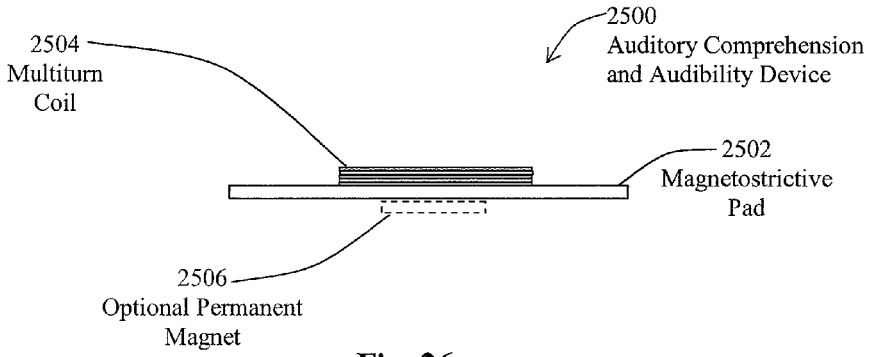
FIG. 26 is a side view of the auditory comprehension and audibility device of FIG. 25.

FIG. 26 is a side view of the auditory comprehension and audibility device 2500. As illustrated in FIG. 26, a multi-turn coil 2504 is disposed on the upper surface of the magnetostrictive pad 2502. The multi-turn coil 2504 may be attached to the magnetostrictive pad 2502 in any desired manner including bonding, gluing, welding or molding the multi-turn coil 2504 to the magnetostrictive pad 2502. Multi-turn coil 2504 may use wire, such as used to wrap transformers and electric motors. Varying effects can be provided by varying the number of coil turns of the multi-turn coil 2504, as well as the size and the thickness of the magnetostrictive pad 2502. For example, broader changes across the frequency spectrum are achieved with few turns, while a greater number of turns creates changes in a narrower frequency band. Optional permanent magnet 2506, as illustrated in FIG. 26, is disposed on an opposite side of the magnetostrictive pad 2502 from the multi-turn coil 2504, or can be disposed on the same side. The optional permanent magnet can be attached to the magnetostrictive pad 2502 in any desired manner, including various ways of bonding, welding, or other methods.

Figure 27:
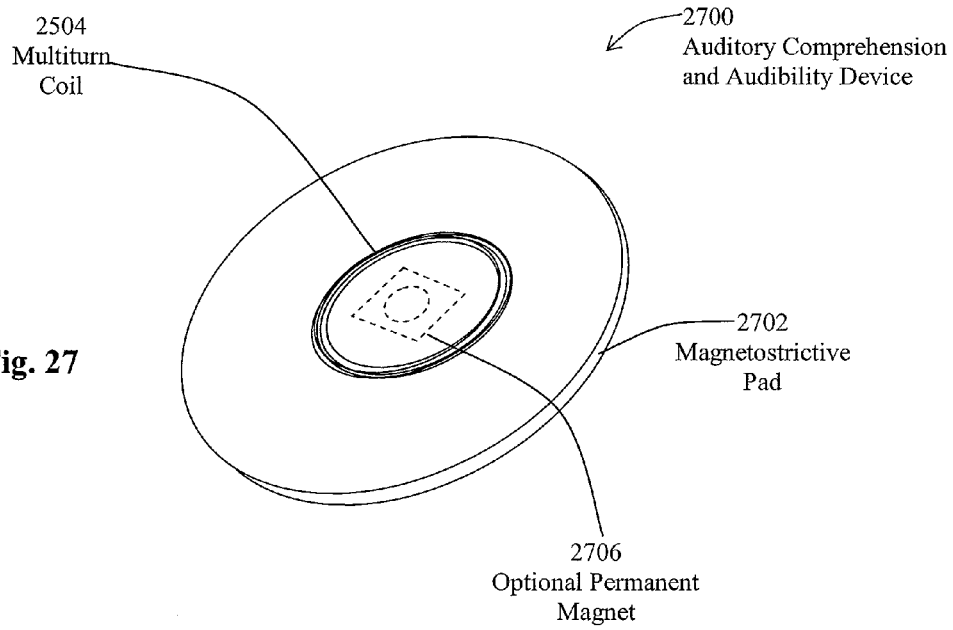
FIG. 27 is an isometric schematic view of an embodiment of an auditory comprehension and audibility device.

FIG. 27 is an isometric schematic view of an embodiment of an auditory comprehension and audibility device 2700. As shown in FIG. 27, a multi-turn coil 2702 has a round or oval shape, which matches the round or oval shape of the magnetostrictive pad 2704. The magnetostrictive pad 2704, as well as the multi-turn coil 2702, can have any desired shape and may be designed to have a shape that matches the shape of a particular implementation in which the auditory comprehension and audibility device 2700 is deployed.

Figure 28:
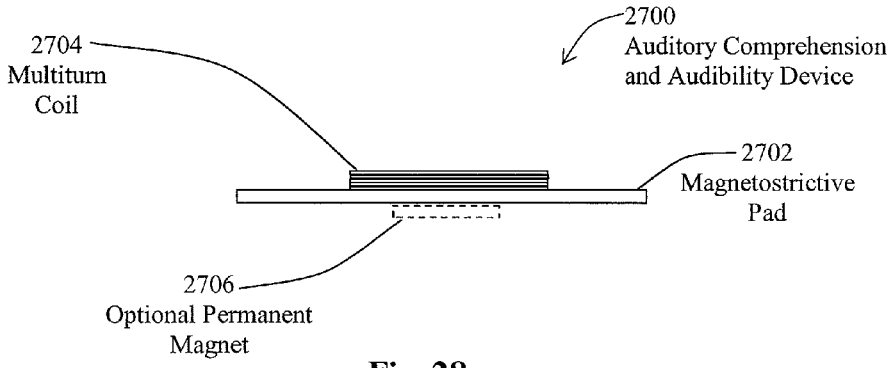
FIG. 28 is a side view of the auditory comprehension and audibility device of FIG. 27.

FIG. 28 is a side view of the auditory comprehension and audibility device 2700. As shown in FIG. 28, the multi-turn coil 2702 is attached to the magnetostrictive pad 2704 using any desired type of bonding technique.

As also shown in FIGS. 27 and 28, an optional permanent magnet 2706 can be disposed on the magnetostrictive pad 2704 on an opposite side from the multi-turn coil 2702. The permanent magnet 2706 can be a commonly available magnet, or may be a high powered magnet constructed from rare earth materials. Again, the presence of the permanent magnet 2706 may function to increase the magnetic coupling between the auditory comprehension and audibility device 2700 and a speaker that is located proximate to the auditory comprehension and audibility device 2700. In addition, the permanent magnet 2706 may be located on the same side of the magnetostrictive pad 2704 and disposed within the opening of the multi-turn coil 2702.

Figure 29:
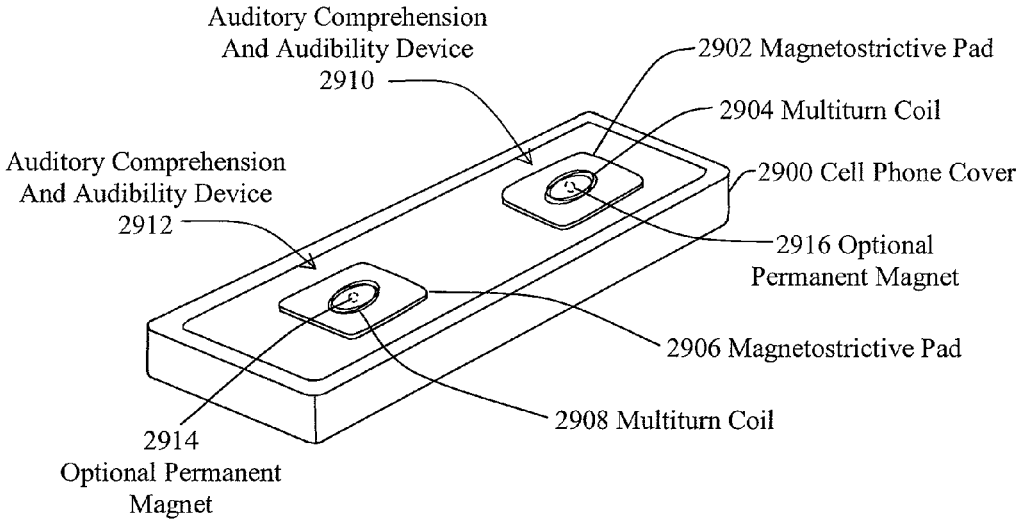
FIG. 29 is a perspective view of a pair of auditory comprehension and audibility devices disposed in a cell phone cover.

FIG. 29 is a perspective view of a pair of auditory comprehension and audibility devices 2910, 2912 disposed in a cell phone cover 2900. Auditory comprehension and audibility devices 2910, 2912 may be attached to the interior surface of the cell phone cover 2900 or molded into or over the material of the cell phone cover 2900. In addition, the auditory comprehension and audibility devices 2910, 2912 may be placed between layers of cell phone cover 2900. For example, the auditory comprehension and audibility device 2912 may be placed between a silicon layer and a hard layer of cell phone cover 2900. Similarly, another auditory comprehension and audibility device 2912 can be placed in the cell phone cover 2900 in close proximity to a microphone in the cell phone that is encased by the cell phone cover 2900. Auditory comprehension and audibility device 2910 increases the auditory comprehension and audibility of a listener of the cell phone enclosed by the cell phone cover 2900 while expanding access and cell phone usage for persons with hearing loss and other auditory challenges. Optional permanent magnet 2916 may also increase audibility in the presence of electromagnetic interference. In a similar manner, auditory comprehension and audibility device 2912 increases the speech discrimination of the voice signal generated by the microphone in a cell phone that is encased in the cell phone cover 2900. Optional permanent magnet 2914 may also increase audibility of the microphone signal. Auditory comprehension and audibility device 2910 has a multi-turn coil 2904 that is placed on a magnetostrictive pad 2902 to create greater speech discrimination in the speaker of the cell phone encased by the cell phone cover 2900. Auditory comprehension and audibility device 2912 includes a multi-turn coil 2908, which is placed adjacent to the magnetostrictive pad 2906 to increase speech discrimination of the auditory signal in the microphone of the cell phone that is encased by the cell phone cover 2900. Although a cell phone cover is illustrated in FIG. 29, covers for various types of devices can include an auditory comprehension and audibility device. For example, an auditory comprehension and audibility device can be provided in computer covers, such as covers for portable computers, satellite telephones, other types of portable or mobile phones, hearing aids, various types of hearing instruments, including assistive hearing technology devices, walkie-talkies, test equipment, PDAs, medical equipment, etc. These devices may be used in consumer electronics, telecommunications devices, communication devices, medical diagnostic devices, x-ray devices, transportation, defense, amusement, racing, lighting, etc.

Further, the auditory comprehension and audibility devices disclosed in the various embodiments herein reduce electromagnetic interference. Typically, when users of hearing devices enter areas of high electromagnetic interference, the hearing device typically will pick up the electromagnetic interference and create a large amount of interfering background noise in the hearing device when set on M-T setting or T setting. In such cases, users of the hearing device will typically have to turn off, or change the setting or remove the hearing device because of the large amount of interference noise. Use of an auditory comprehension and audibility device, such as illustrated in the various embodiments disclosed herein, reduces the electromagnetic interference and allows the user to continue to use the hearing device. The use of an optional permanent magnet, such as illustrated in the various embodiments disclosed herein, may help to affect the reduction of electromagnetic interference.

Figure 30:
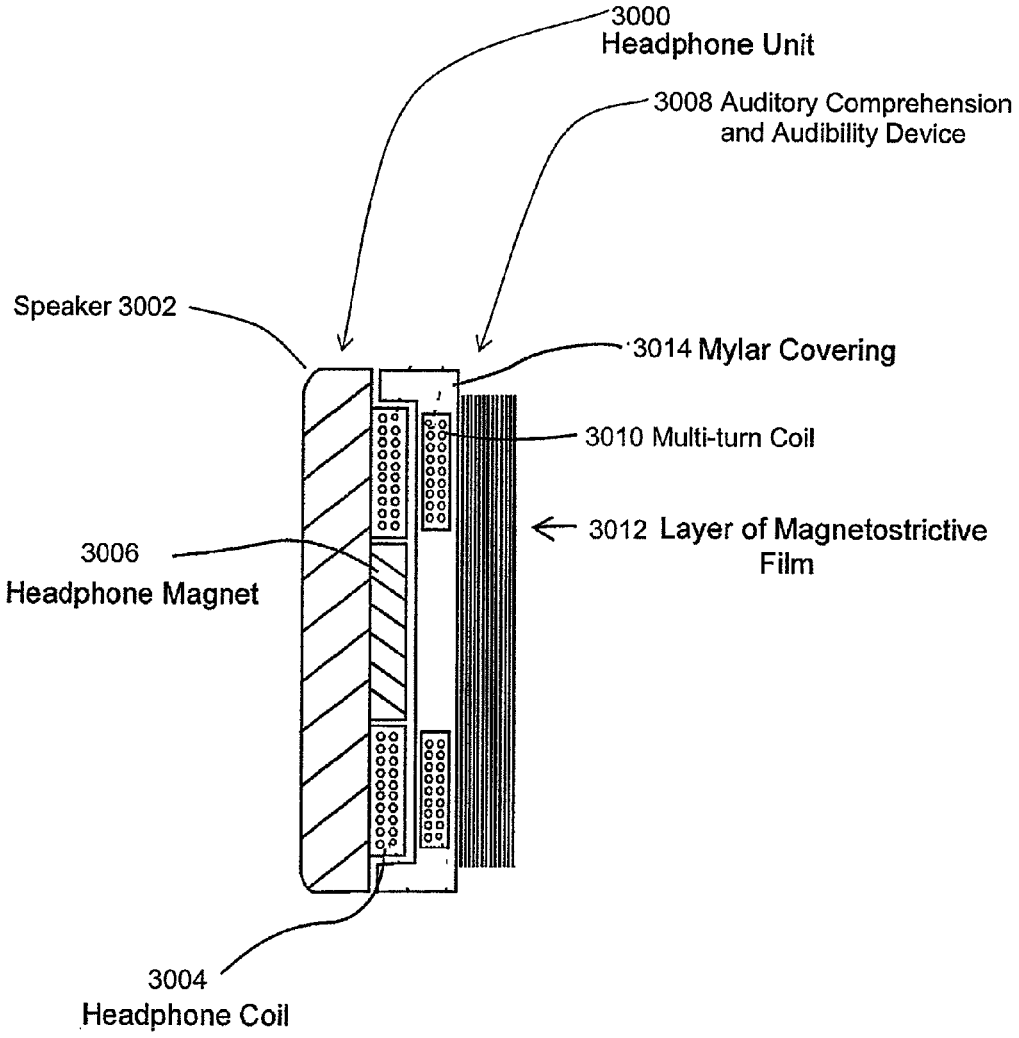
FIG. 30 is an embodiment of a head phone unit similar to the embodiments illustrated in FIGS. 25-29.

FIG. 30 illustrates an embodiment of a head phone unit 3000 and auditory comprehension and audibility device 3008 that is similar to the embodiments illustrated in FIGS. 25-29. As illustrated in FIG. 30, the head phone unit 3000 includes a speaker 3002, such as those typically found in head phone units. The speaker 3002 is driven by a head phone magnet 3006 and a head phone coil 3004, which generates a magnetic field that moves the head phone magnet 3006. The speaker 3002, the head phone coil 3004 and the head phone magnet 3006 are standard items found in a head phone unit. Attached to the head phone unit 3000 is an auditory comprehension and audibility device 3008. The auditory comprehension and audibility device 3008 includes a multi-turn coil 3010, layers of magnetostrictive film 3012 and a Mylar covering 3014 that attaches to the head phone unit 3000. Other types of coverings can be used. The multi-turn coil 3010, unlike the multi-turn winding 1210 of FIG. 12, is not connected to the headphone coil 3004. Hence, the auditory comprehension and audibility device 3008 is electrically isolated from the head phone 3000 and the head phone coil 3004.

The embodiments of FIGS. 25-30 increase the quality of the auditory signal generated by a speaker that is disposed near the auditory comprehension and audibility devices of FIGS. 25-30 to allow better speech discrimination and better audibility of the listener. Although not fully understood, it is believed that there is a magnetic field coupling between the speaker coil, such as head phone coil 3004 of FIG. 30 of the speaker, and the multi-turn coil, such as multi-turn coil 3010, of the auditory comprehension and audibility device 3008. This occurs not only in a headphone unit, such as headphone unit 3000, but also in other implementations, such as with mobile phones, satellite phones, computer speakers, or any device that includes a speaker or sound generation device. Magnetic coupling, of course, increases non-linearly as the distance between the auditory comprehension and audibility device 3008 and a speaker unit is reduced. In testing, it has been determined that placement of the electrically isolated auditory comprehension and audibility device 3008 of the embodiment of FIG. 30 produces substantially the same response as the auditory comprehension and audibility device that is electrically connected to the headphone coil 1204 of FIG. 12. It is believed that the magnetic coupling causes the magnetostrictive material to change sizes in the presence of the magnetic field, which produces a feedback response, which alters the operation of the speaker to create better speech discrimination of the generated audio signal that is heard by the user.

Figure 31:
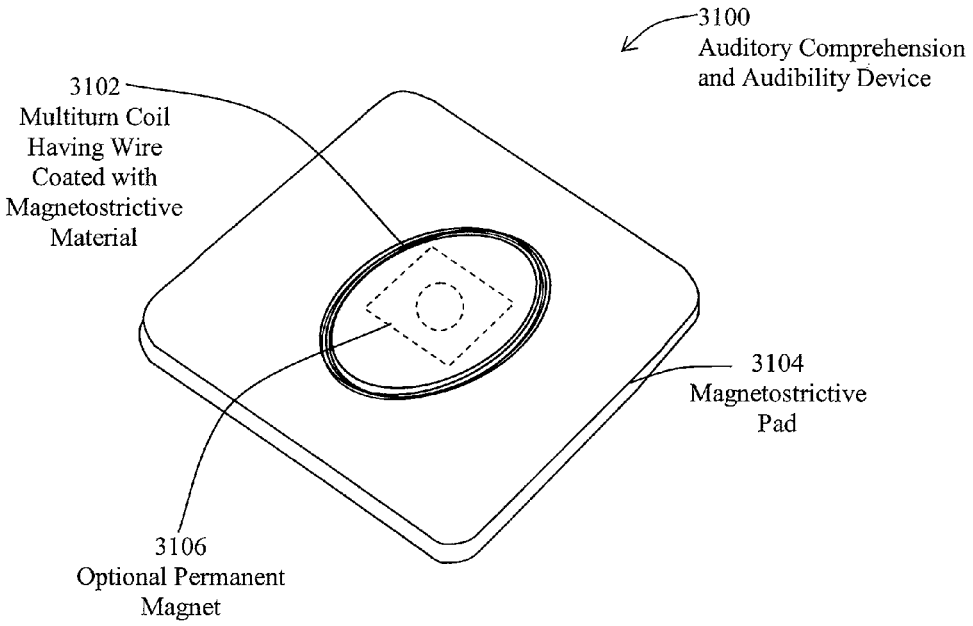
FIG. 31 is a schematic isometric view of an embodiment of an auditory comprehension and audibility device.

FIG. 31 is a schematic isometric view of another embodiment of an auditory comprehension and audibility device 3100. As shown in FIG. 31, the auditory comprehension and audibility device 3100 includes a multi-turn coil 3102 that utilizes a wire that is coated with a magnetostrictive material. The multi-turn coil 3102 is disposed adjacent to a magnetostrictive pad 3100. The combination of the magnetostrictive material that coats the multi-turn coil 3102 and the magnetostrictive pad 3104 function to alter the output of a speaker when placed adjacent to the speaker. Again, it is believed that magnetic coupling occurs between the speaker magnetic field, which induces a current in the multi-turn coil 3102, which, in turn, creates a feedback magnetic field that alters the magnetic field of the speaker, so that the auditory output of the speaker is modified to increase speech discrimination and audibility by the listener of the speaker. The combination of the magnetostrictive coating on the wire of the multi-turn coil 3102, as well as the magnetostrictive pad 3104, create the induced magnetic field. Of course, the multi-turn coil wire that is coated with magnetostrictive material 3102 may be coated with a light insulator, such as used on copper wires, to insulate the multi-turn coil. In addition, the magnetostrictive pad 3104 can be coated with a light insulated material, to also prevent conduction between the multi-turn coil 2103 and the magnetostrictive pad 3104.

As also illustrated in FIG. 31, an optional permanent magnet 3106 can be placed on an opposite side, or the same side, of the magnetostrictive pad 3104 from the multi-turn coil 3102. The optional permanent magnetic 3106 may be constructed from any desirable type of magnetized material, including rare earth magnetized material. In addition, the permanent magnetic 3106 may be placed within the opening of the multi-turn coil 3102. Optional permanent magnet 3106 is believed to help reduce the generation of noise in a speaker resulting from electromagnetic interference.

Figure 32:
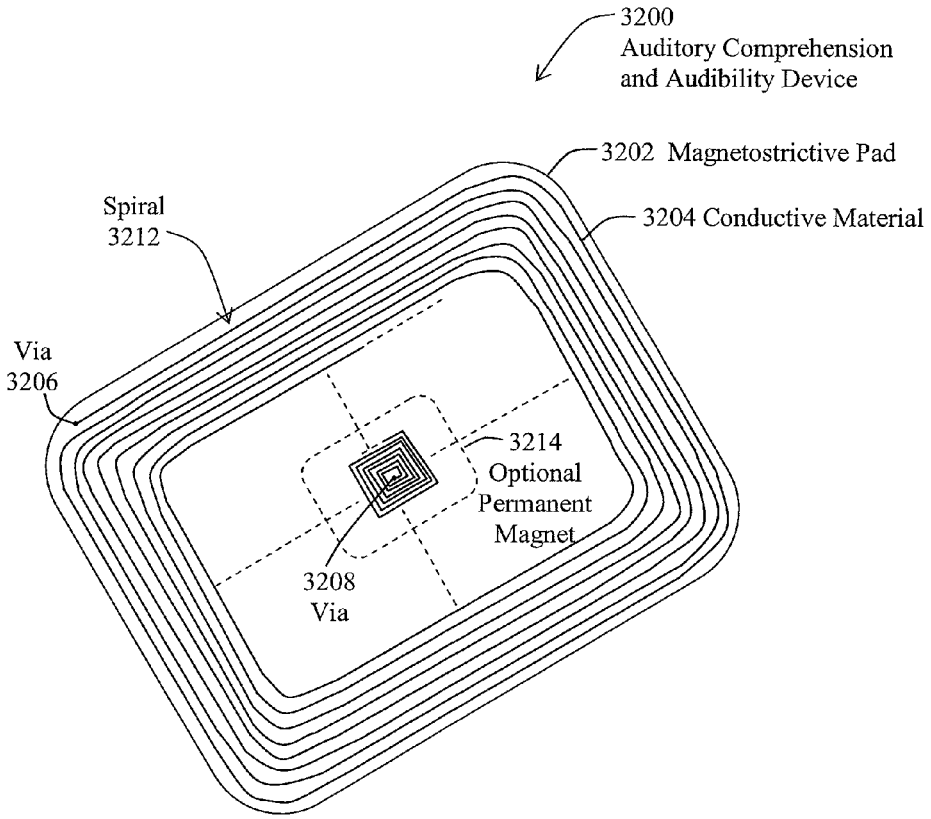
FIG. 32 is a schematic top view of an embodiment of an auditory comprehension and audibility device.
Figure 33:
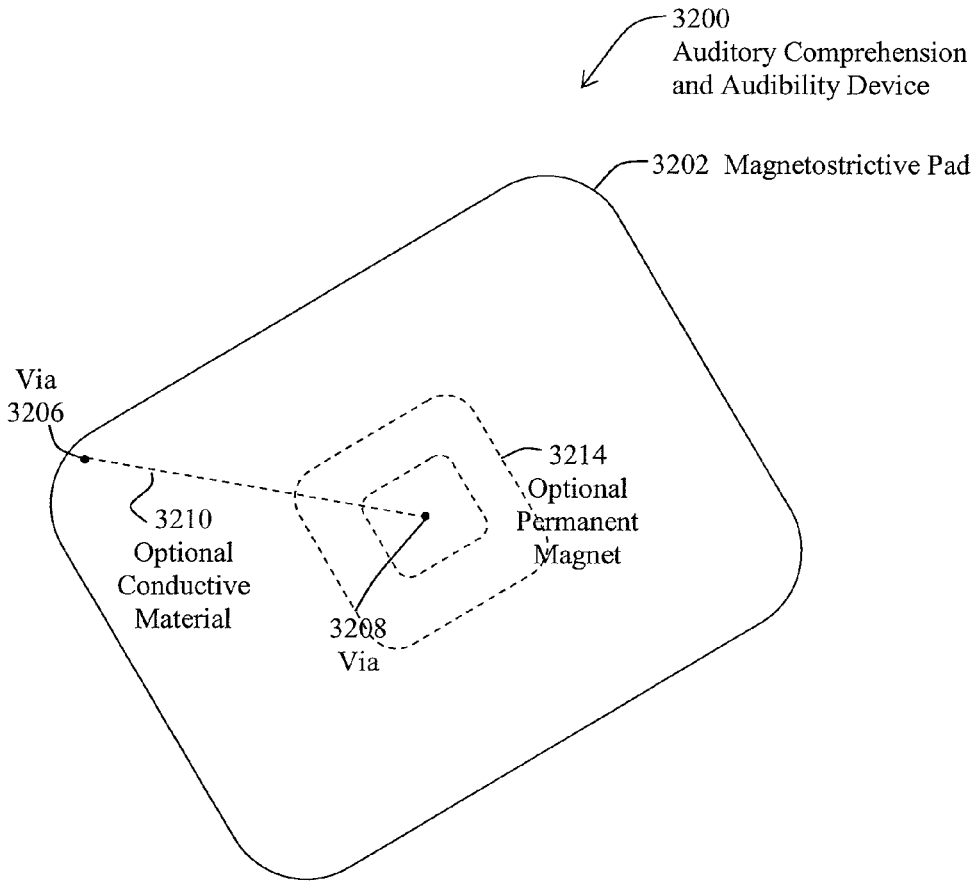
FIG. 33 is a schematic view of the opposite side of the magnetostrictive pad illustrated in FIG. 32.

FIG. 32 is a schematic top view of another embodiment of an auditory comprehension and audibility device 3200. As illustrated in FIG. 32, the auditory comprehension and audibility device 3200 includes a magnetostrictive pad 3202 and a conductive material 3204 deposited on a surface of the magnetostrictive pad 3202. The conductive material 3204 is formed in a spiral 3212, so that current flowing through the conductive material 3204 creates a magnetic field. The conductive material 3204 can be deposited on the surface of the magnetostrictive pad 3202 using any desired means, including screening techniques, such as silk screening using conductive inks, or other conductive materials, sputtering, vapor deposition, etc. The magnetostrictive pad 3202 can be coated with a light insulative material that minimally affects the expansion and contraction of the magnetostrictive material in the magnetostrictive pad 3202 in the presence of a changing magnetic field. Any type of insulative layer can be used, including a deposited insulative material, or an insulative material that is attached to the magnetostrictive pad 3202, but does not substantially restrict the expansion and contraction of the magnetostrictive pad 3202. Very thin coatings can accept conductive inks or other conductive material and conductive screened materials. The conductive material 3204 is connected to vias 3206, 3208 to provide a conductive path through the magnetostrictive pad 3202 to an opposite side of the magnetostrictive pad 3202. The vias may be filled with a conductive material or lined with a conductor to provide a conductive path to the opposite side of the magnetostrictive pad 3202. Conduction may also be provided using side connectors. In another embodiment, vias 3206, 3208 are not used and the ends of the coil are not connected. In that regard, the conductive material 3210, illustrated in FIG. 33, is not used to connect vias 3206, 3208. In addition, although the spiral 3212 is shown as filling the entire surface, including the inner portion of the surface of the magnetostrictive pad 3202, the same techniques can be used so that only the outer portions of the spiral 3212 are placed on the magnetostrictive pad 3202. In other words, the spiral coils of conductive material 3204 that are disposed on the surface of the magnetostrictive pad 3202 can be connected through a via (not shown) to via 3206, so that only the outer portions of the magnetostrictive pad 3202 are coated with a conductive material 3204 in a spiral 3212. In that regard, the conductive material 3204 can be placed in a spiral at any location on the surface of the magnetostrictive pad 3202. For example, the open spaces shown in FIG. 32 may be utilized for placement of conductive material 3204 in a spiral shape to form a coil on the surface of the magnetostrictive pad 3202. Vias can be used to connect the ends of such a coil. In that case, the center portion may be left open.

As also shown in FIG. 32, a permanent magnetic 3214 may optionally be employed with the auditory comprehension and audibility device 3200. The optional permanent magnetic 3214 may help to reduce the noise created by electromagnetic interference in a speaker located proximate to the auditory comprehension and audibility device 3200. The size of the permanent magnet 3214 can be varied to vary the effect of the auditory comprehension and audibility device 3200, as well as the strength of the magnetic field created by the permanent magnet 3214. Empirical data from tests using various types of magnets having various strengths and sizes can be used to optimize a design for use with any particular speaker and the ability to reduce noise created by electromagnetic interference. Similarly, the number of windings of the conductive material 3204, as well as the size and thickness of the magnetostrictive pad 3202 can be varied and empirical data can be collected to optimize the design of the auditory comprehension and audibility device 3200 for any particular speaker. In that regard, the size and shape of the magnetostrictive pads of the various embodiments disclosed herein, as well as the size and number of windings of the various coils associated with the magnetostrictive pads can be altered to obtain the optimal design for the various embodiments of the auditory comprehension and audibility devices disclosed herein. More specifically, the fewer the number of windings in the coil, the broader the frequency response of the auditory comprehension and audibility device 3200. In contrast, if the coil contains a greater number of turns, a more pronounced frequency response is provided. Typically, the response occurs in the 3,000 to 4,000 Hz frequency range, which allows for better speech discrimination.

FIG. 33 is a schematic view of the opposite side of the magnetostrictive pad 3202. As shown in FIG. 33, the auditory comprehension and audibility device 3200 has an optional conductive material 3210 that connects the vias 3206, 3208. In that manner, the conductive path is completed between the ends of the spiral 3212, as illustrated in FIG. 32. Other embodiments do not connect the ends of the spiral 3212. A varying magnetic field, created by a speaker, that passes through the magnetostrictive material 3202 can induce an electric current in the spiral 3212, which, in turn, creates a responsive magnetic field that is created by the spiral 3212. The responsive magnetic field is altered by the magnetostrictive pad 3202. The feedback of the electromagnetic field may then alter the output of a speaker that is placed near the auditory comprehension and audibility device 3200.

Figure 34:
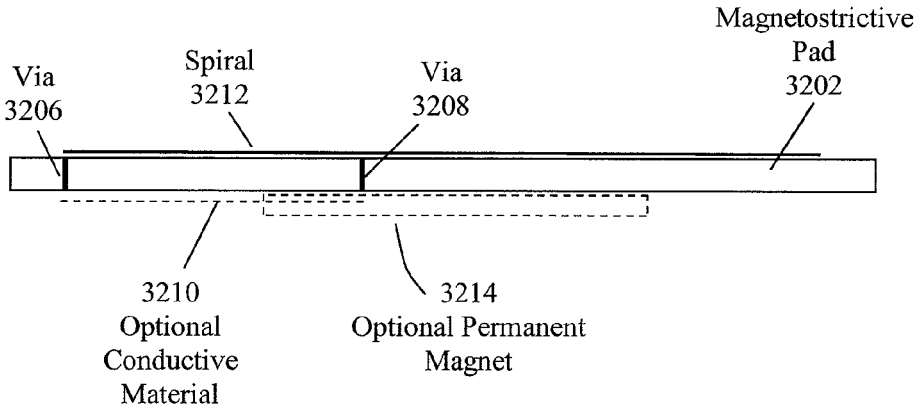
FIG. 34 is a side cutaway view of the embodiments illustrated in FIGS. 32 and 33.

FIG. 34 is a side cutaway view of the embodiment illustrated in FIGS. 32 and 33. As illustrated in FIG. 34, the spiral of conductive material 3212 is deposited on a first side of the magnetostrictive pad 3202. The spiral 3212 is connected to the via 3208 that is filled or coated with a conductive material. Spiral 3212 is also connected to via 3206, which is filled or lined with a conductive material. In this fashion, conductor 3210, which is disposed on an opposite side of the magnetostrictive pad 3202, is electrically connected to the ends of the spiral 3212 by optional conductor 3210. Other embodiments do not connect the ends of the spiral 3212. Optional permanent magnet 3214 can be disposed on either side of the magnetostrictive pad 3202 and attached in any desired manner.

Figure 35:
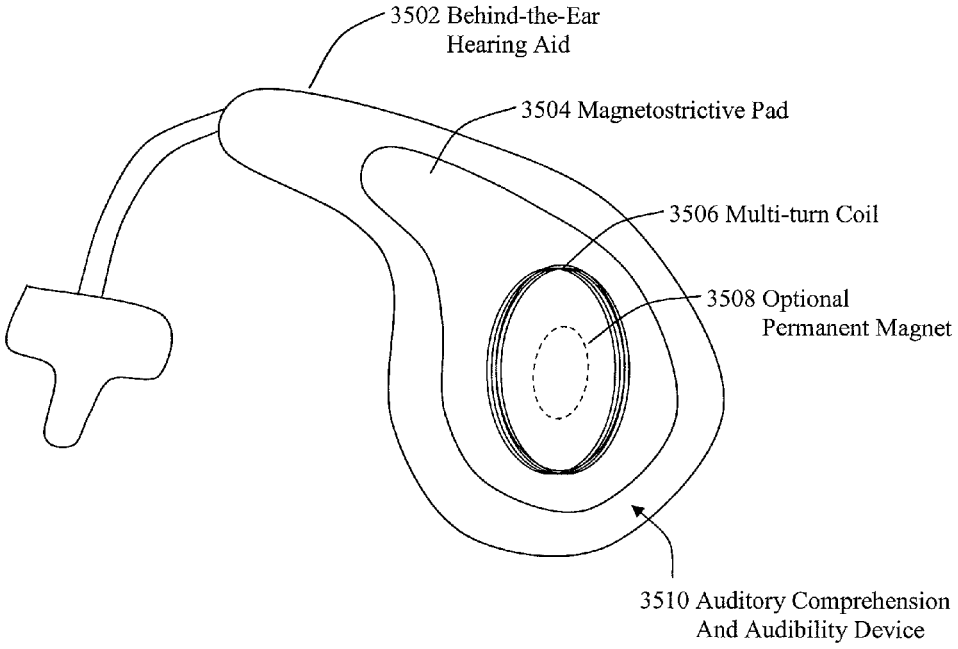
FIG. 35 is a schematic illustration of a behind-the-ear hearing aid that is modified to include an auditory comprehension and audibility device.

FIG. 35 is a schematic illustration of behind-the-ear hearing aids 3502 that are modified to include an auditory comprehension and audibility device 3510. As illustrated in FIG. 35, a magnetostrictive pad 3504 is disposed on behind-the-ear hearing aids 3502. A multi-turn coil 3506 is disposed on the magnetostrictive pad 3504. An optional permanent magnet 3508 can also be disposed on the magnetostrictive pad 3504. The magnetostrictive pad 3504 and multi-turn coil 3506, as well as an optional permanent magnet 3508, form the auditory comprehension and audibility device 3510, which affects the auditory signals generated by behind-the-ear hearing aids 3502 in the manner described above.

Figure 36:
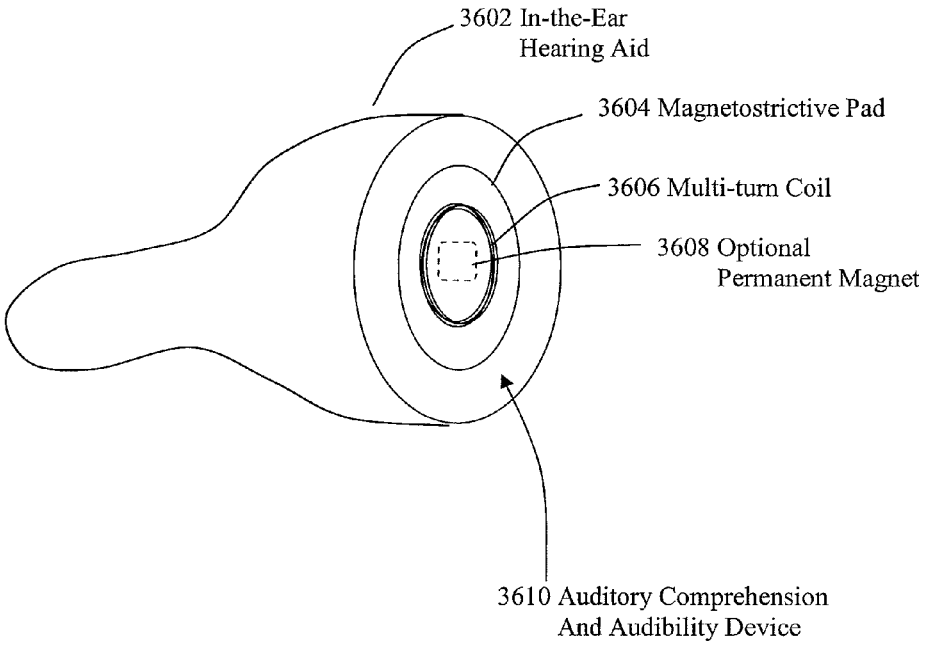
FIG. 36 is a schematic illustration of another embodiment of an auditory comprehension and audibility device.

FIG. 36 illustrates another implementation of the auditory comprehension and audibility device 3610. As illustrated in FIG. 36, behind-the-ear hearing aids 3602 are modified to include an auditory comprehension and audibility device 3610 that modifies the auditory signal generated by the hearing aid 3602. The auditory comprehension and audibility device 3610 includes a magnetostrictive pad 3604, a multi-turn coil 3606, and an optional permanent magnet 3608. The auditory comprehension and audibility device 3610 enhances speech discrimination and/or audibility for the listener and reduces EMI.

Figure 37:
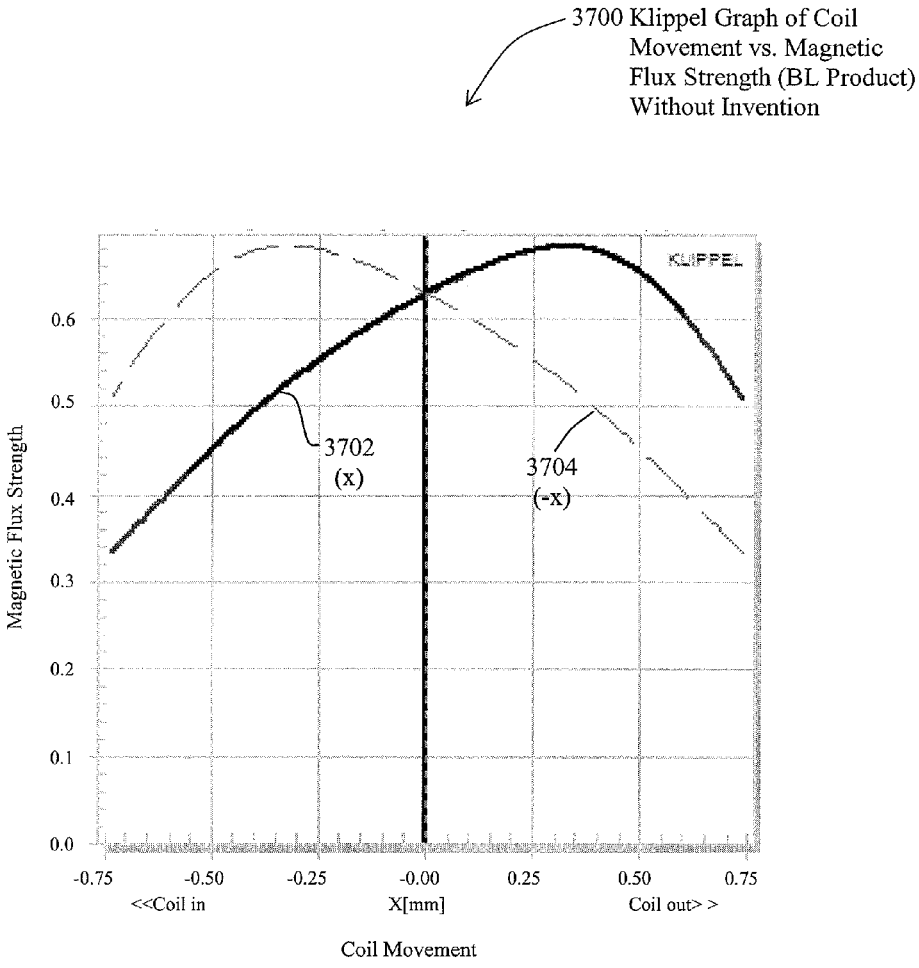
FIG. 37 is a Klippel graph of coil movement versus magnetic flux strength.

FIG. 37 is a Klippel graph 3700 of coil movement versus magnetic flux strength without the use of an auditory comprehension and audibility device, such as auditory comprehension and audibility device 3008, illustrated in FIG. 30. Graph 3700 illustrates the BL product, where B is the strength of the magnetic field and L is the length of the coil used to generate the magnetic field. The BL product is a measure of the motive force that is applied to the speaker cone using a voice coil in a headphone-Model 707v, made by Groove Industries Co. Ltd, Rm703 A, Huangdu Plaza, Yitian Rd, Futian, Shenzhen, China. Plot 3702 illustrates the BL product for positive currents and plot 3704 illustrates the BL products for negative currents. As is clear from FIG. 37, motive force is not equally applied around the zero displacement axis.

Figure 38:
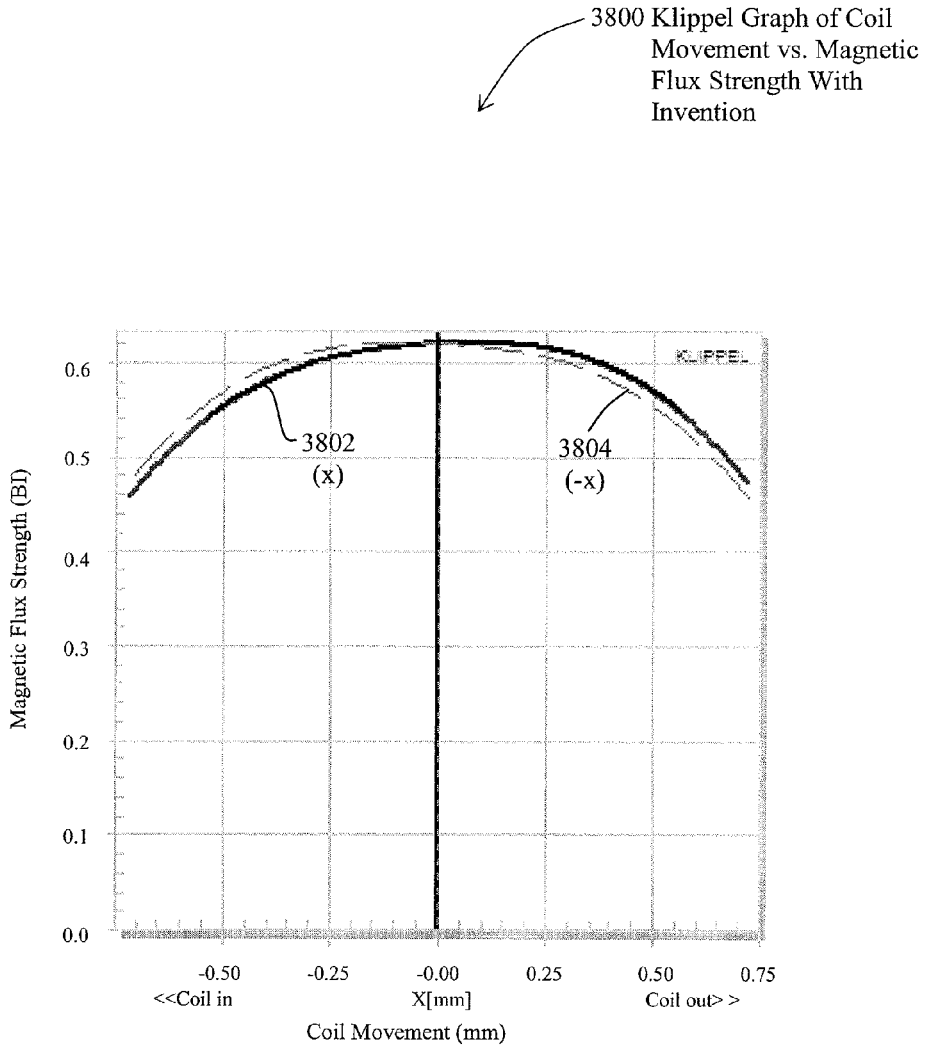
FIG. 38 is a Klippel graph of coil movement versus magnetic flux strength that incorporates one embodiment of the invention.

FIG. 38 illustrates a Klippel graph 3800 of coil movement versus magnetic flux with the same headphones of FIG. 37 modified with an auditory comprehension and audibility device, such as auditory comprehension and audibility device 3008, illustrated in FIG. 30. The auditory comprehension and audibility device 3008 included 100 windings of 36 gauge copper wire and 16 mm layers of magnetostrictive material, which was 1 1/32 inches in diameter. As shown in FIG. 38, the BL product is shown in a plot 3802 for positive X and 3804 for negative X, for the same Groove, Model 707v headphone that was modified in the manner described with respect to FIG. 30. Both of the plots 3802, 3804 have a broad bell-shaped curve that is centered on the zero position of the voice coil. As such, greater efficiency is achieved with the modified system and greater efficiency and improved driver performance is realized, as illustrated in FIG. 38.

The balanced performance of the coil movement that is realized using the modified system, such as illustrated in FIG. 30, results in higher efficiency of the system. The higher efficiency is the result of a lower current draw that is required to move the voice coil of the speaker with less motive force and, hence, less current. As a result, the battery drain is significantly less. As indicated above, the Starkey Model 675 was extended from 2-3 days battery life up to 11-14 days when the hearing aid was used 24 hours a day. When the hearing aid was used 16 hours a day, the battery life was extended from 3-4 days up to 24-28 days.

Figure 39:
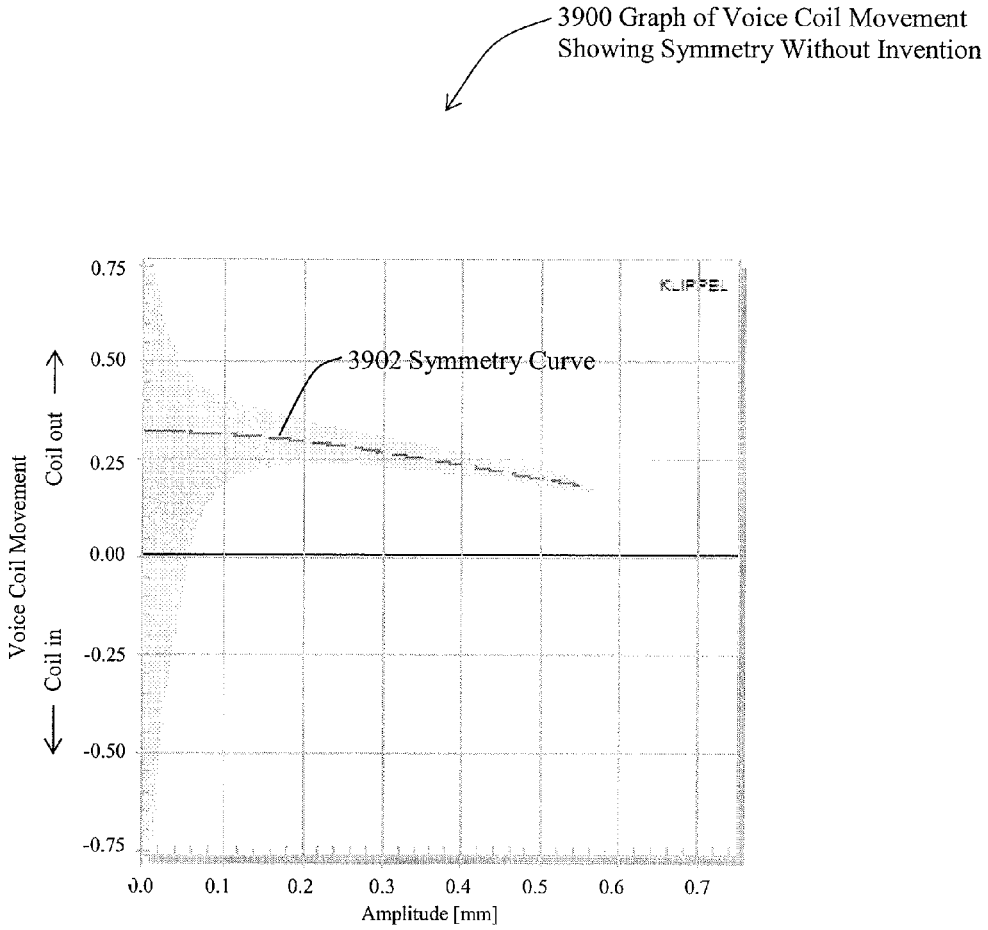
FIG. 39 is a graph of voice coil movement showing symmetry without use of one embodiment of the invention.

FIG. 39 is a graph 3900 of voice coil movement showing symmetry in a Groove Model 707v headphone that does not use the retrofitted system, illustrated in FIG. 30. As shown in FIG. 39, plot 3902 of the symmetry curve shows an offset of the voice coil movement from the center position. The offset of the symmetry curve 3902 reduces the symmetry of the Groove Model 707v headphone.

Figure 40:
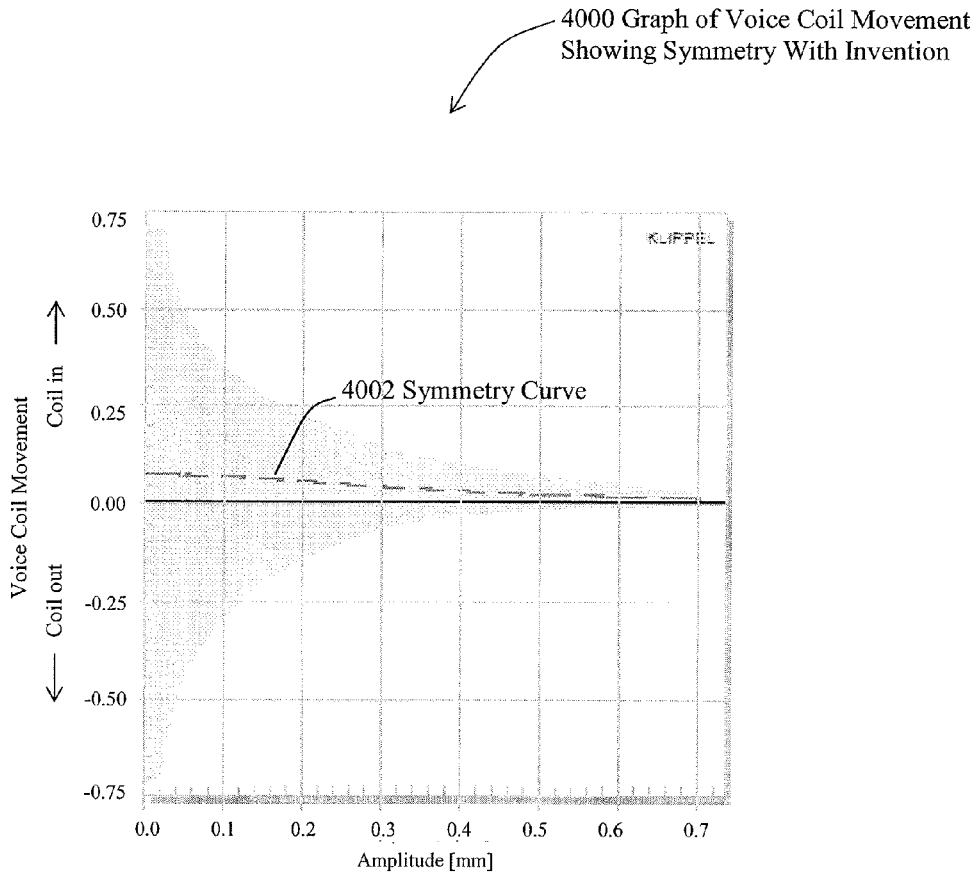
FIG. 40 is a graph of voice coil movement showing symmetry that incorporates one embodiment of the invention.

FIG. 40 is a graph 4000 showing the symmetry of movement of the voice coil utilizing a system such as illustrated in FIG. 30. The auditory comprehension and audibility device 3008 included 100 windings of 36 gauge copper wire and 16 mm layers of magnetostrictive material, which was 1 1/32 inches in diameter. The symmetry curve 4002 illustrates that the voice coil movement is substantially aligned with the center position of the voice coil. The symmetry of curve 4002 results in increased efficiency of the operation of the voice coil.

Figure 41:
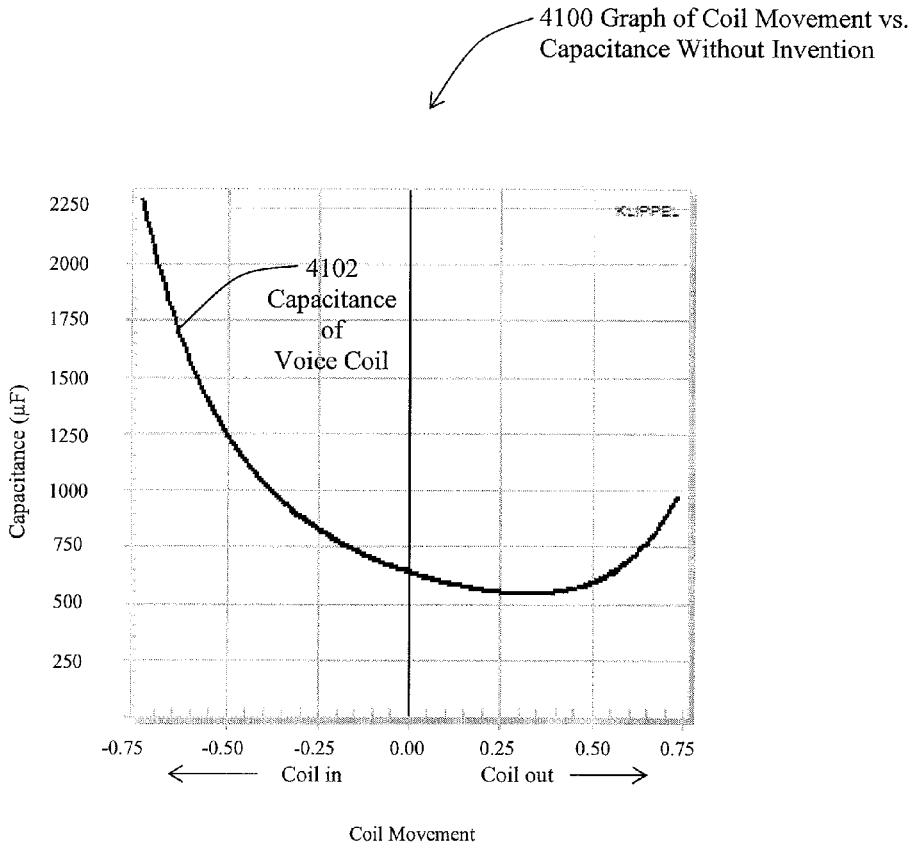
FIG. 41 is a graph of coil movement versus capacitance in a headphone.

FIG. 41 is a graph 4100 illustrating the coil movement of the voice coil versus the capacitance in a Groove Model 707 headphone, identified above with respect to FIG. 37, that is not retrofitted as illustrated in FIG. 30. As shown in FIG. 41, plot 4102 illustrates the capacitance of the voice coil in microfarads as a function of the coil movement. As shown in FIG. 41, there is a non-symmetrical relationship between the capacitance and the coil movement when the coil is moving in an inward direction and an outward direction when the headphone is not retrofitted with the system of FIG. 30.

Figure 42:
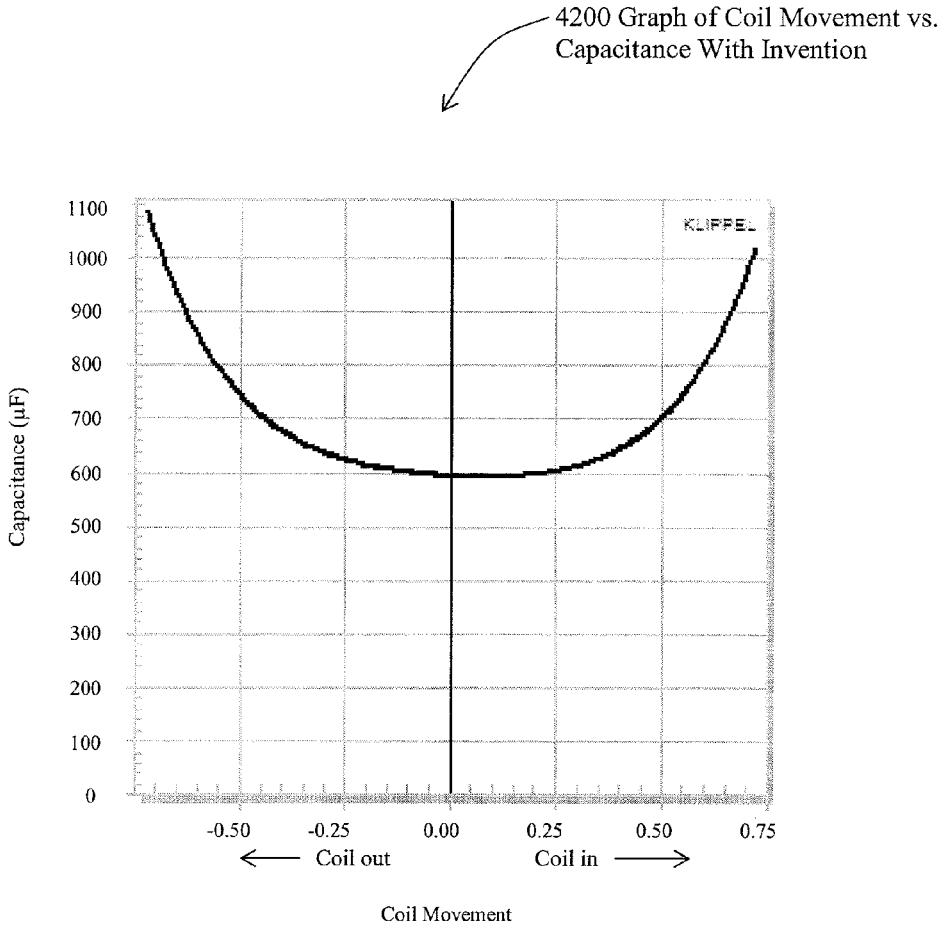
FIG. 42 is a graph of coil movement versus capacitance that incorporates one embodiment of the invention in a headphone.

FIG. 42 is a graph 4200 of the coil movement versus capacitance for a Groove Model 707v, described above with respect to FIG. 37, headphone that has been retrofitted with the system illustrated in FIG. 30, as disclosed above. As illustrated in FIG. 42, the capacitance in microfarads is substantially symmetrical for movements of the coil in both an inward and outward direction. The improved symmetry also functions to increase the efficiency of the retrofitted system.

Figure 43:
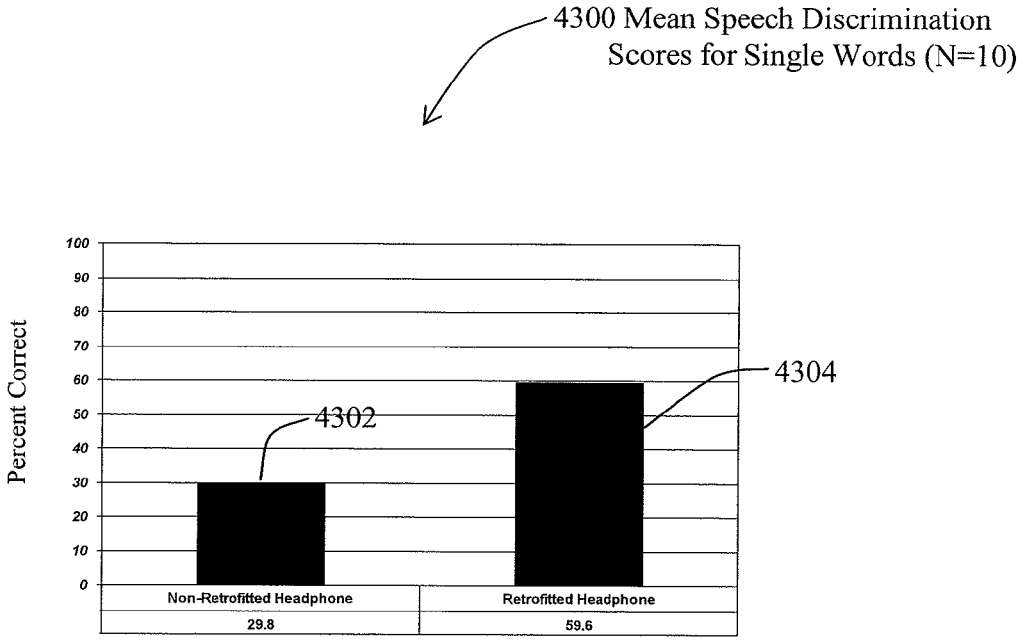
FIG. 43 is a bar graph illustrating mean speech discrimination scores for single words.

FIG. 43 is a bar graph 4300 that illustrates the mean speech discrimination scores for single words using non-retrofitted and retrofitted Groove headphones described above. Test protocol was the same as the test performed as described above with respect to FIGS. 13-14*a*. The bar graph 4300 illustrates the percentage of correct answers for fifty and twenty-five single words from standardized NU-6 and Campbell's word lists in CD format using both non-retrofitted headphones and retrofitted headphones. The bar graph 4302 indicates a correct percent of 29.8% for non-retrofitted headphones, while bar graph 4304 indicates a 59.6% of correct answers for the Groove Model 707v headphone that has been retrofitted with the system illustrated in FIG. 30 and as described above with respect to FIG. 38. FIG. 43 illustrates that there is substantially a doubling of the speech discrimination using headphones that have been retrofitted with the system of FIG. 30.

Figure 44:
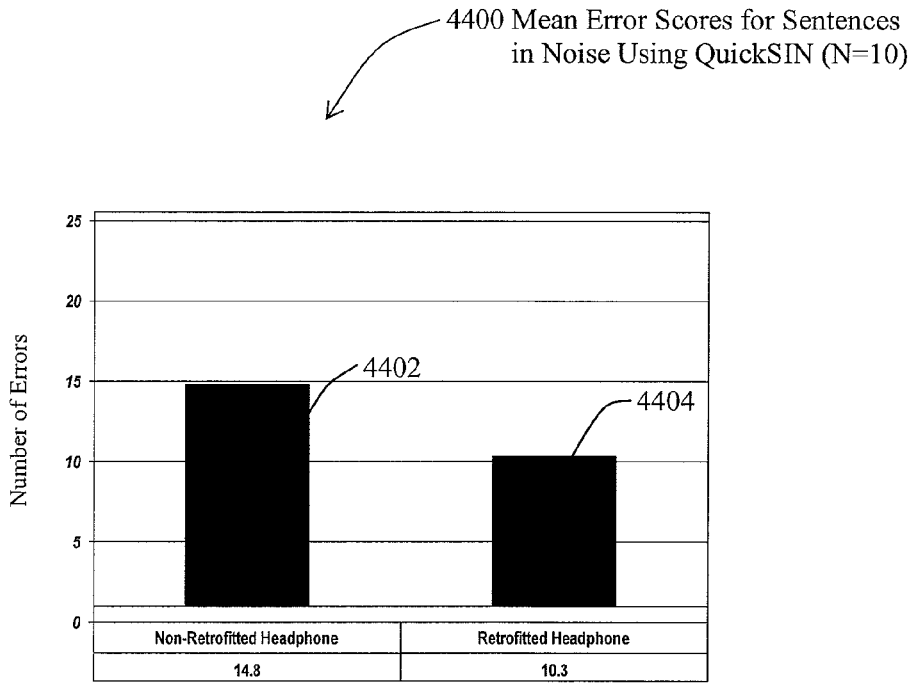
FIG. 44 is a bar graph illustrating mean error scores for sentences in noise using a QuickSIN test.

FIG. 44 is a bar graph 4400 illustrating the mean error scores for sentences in noise using a QuickSIN Speech-in-Noise test, Version 1.3. This test is available from Etymotic Research, Inc., 61 Martin Lane, Elk Grove Village, Ill. 60007, and Auditec, Inc., 2515 South Big Bend Blvd., St. Louis, Mo. 63143. In the test illustrated in FIG. 44, there were six sentences with five target words per sentence. With the non-retrofitted headphones, there was a mean of 14.8 errors, as illustrated by the bar graph 4402. With the retrofitted headphone, the mean error score was 10.3 errors, as illustrated in bar 4404. The QuickSIN Speech-in-Noise test was developed as a quick measurement of signal to noise ratio loss. The test is composed of a list of twelve standard equivalent lists of six sentences, with five key words per sentence, presented in four-talker babble noise that includes one male voice and three female voices. The sentences are presented at 70 dB HL for individuals with a pure tone average (500 Hz, 1000 Hz and 2000 Hz) of less than or equal to 45 dB HL or louder, if the pure tone average is higher. The sentences are presented at pre-recorded signal-to-noise ratios, which decrease in 5 dB steps from 25 dB to 0 dB. The maximum signal-to-noise ratio loss is 25.5 or, in other words, 25.5 incorrect responses. Scoring is accomplished by subtracting the number of correct responses from 25.5. The resulting number signifies the signal-to-noise ratio loss, or number of incorrect responses per list. The higher the reported number, the poorer the performance. The QuickSIN Speech-in-Noise test provides a quick and efficient measurement of speech discrimination in noise.

Figure 45:
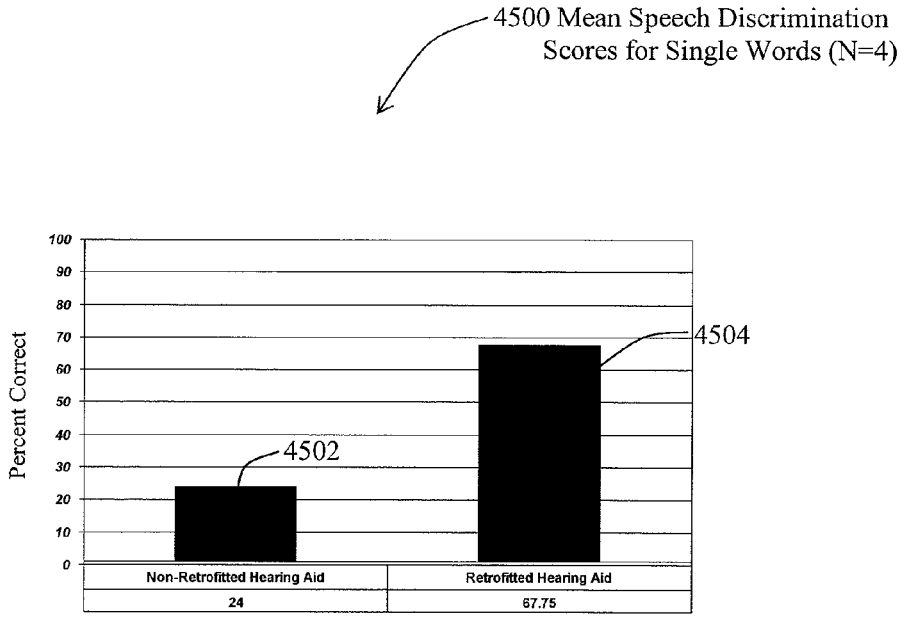
FIG. 45 is a bar graph of mean speech discrimination scores for single words.

FIG. 45 is a bar graph 4500 illustrating the mean speech discrimination scores for single words for non-retrofitted hearing aids and retrofitted hearing aids. As illustrated in FIG. 45, bar 4502 indicates that, for non-retrofitted hearing aids, a mean score of 24% correct responses was achieved. Bar 4504 indicates that hearings aids retrofitted with the device illustrated in FIG. 35 achieved a mean of 67.75% correct score. These tests were performed using various personal hearing aids of subjects that have various degrees of hearing impairment. The hearing aids utilized in this test were comprised of behind-the-ear models that utilized a magnetostrictive pad varying in width of ¼ inches to 19/32 inches, a length of ¼ inches to 1% inches, and a thickness of 1 mm to 16 mm. A multi-turn coil was mounted on the magnetostrictive pad using an insulative copper wire, having a gauge of 36, with 5 to 100 number of coils. The radius of the coils was approximately ¼ inches to 5/16 inches. An optional permanent magnet was not included. FIG. 45 illustrates a significant increase in correct answers, indicating a large increase in speech discrimination using a retrofitted hearing aid that has been retrofitted with the system illustrated in FIG. 35.

Figure 46:
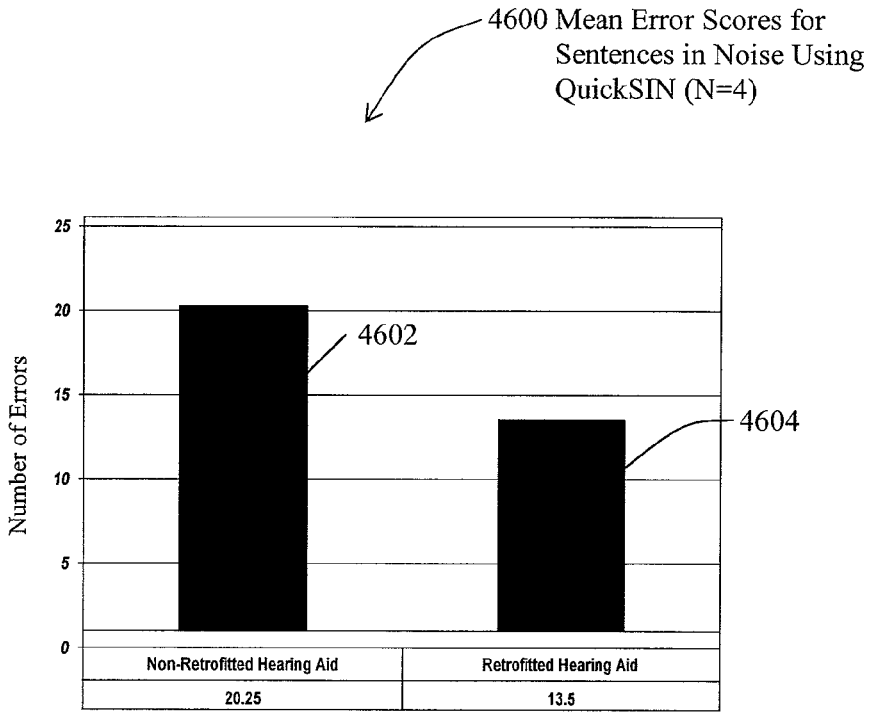
FIG. 46 is a bar graph of mean error scores for sentences in noise using a QuickSIN test.

FIG. 46 is a bar graph 4600 illustrating the mean error scores for sentences in noise using the QuickSIN test, described above using the same subjects and hearing as described above. Bar 4602 indicates 20.25 errors for non-retrofitted hearing aids, whereas bar 4604 indicates only 13.5 errors for retrofitted hearing aids. The bar graph 4600 illustrates a substantial reduction in the number of errors in the retrofitted hearing aid.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A hearing device that assists users having impaired auditory comprehension of sounds generated by a speaker comprising:

a drive coil that drives said speaker;

a magnetostrictive pad that changes size in response to a magnetic field;

a conductive wire formed in a multi-turn coil that is disposed proximate to said magnetostrictive pad and electrically isolated from said drive coil and other components of said hearing device;

said magnetostrictive pad and said multi-turn coil disposed proximate to said speaker, such that said sounds generated by said speaker are altered to provide increased speech discrimination and audibility of sound.

2. The hearing device of claim 1 further comprising:

a permanent magnetic disposed proximate to said magnetostrictive pad.

3. The hearing device of claim 1 wherein said multi-turn coil is bonded to said magnetostrictive pad.

4. The hearing device of claim 1 wherein said speaker is a speaker of a cell phone and said multi-turn coil and said magnetostrictive pad are disposed in a cover for said cell phone.

5. The hearing device of claim 1 wherein said speaker is a speaker in a headset and said multi-turn coil and said magnetostrictive pad are disposed in an attachment to said headset.

6. The hearing device of claim 5 wherein said headset is a hearing aid.

7. A method of increasing auditory comprehension and the audibility of auditory signals generated by a speaker comprising:

providing a drive coil that drives said speaker;

providing a magnetostrictive pad;

providing a multi-turn coil disposed on said magnetostrictive pad that is electrically isolated from said drive coil and other components;

placing said magnetostrictive pad and said multi-turn coil proximate to said speaker so that said auditory signals generated by said speaker are altered to provide increased speech discrimination and audibility for listeners.

8. The method of claim 7 further comprising:

providing a permanent magnet that is disposed proximate to said magnetostrictive pad.

9. The method of claim 7 wherein said multi-turn coil is disposed on said magnetostrictive pad by bonding said multi-turn coil to said magnetostrictive pad.

10. The method of claim 7 wherein said process of disposing said multi-turn coil on said magnetostrictive pad comprises:

depositing said multi-turn coil on said magnetostrictive pad.

11. The method of claim 10 wherein said process of depositing said multi-turn coil comprises:

using vapor deposition techniques to deposit a conductive material on said magnetostrictive pad.

12. The method of claim 10 wherein said process of depositing said multi-turn coil comprises:

using screening techniques to screen a conductive liquid on said magnetostrictive pad.

13. The method of claim 10 wherein said process of depositing said multi-turn coil comprises:

sputtering a conductive material on said magneto strictive pad.

* * * * *